US012442266B2

(12) United States Patent
Jagadesan

(10) Patent No.: US 12,442,266 B2
(45) Date of Patent: Oct. 14, 2025

(54) CONVERTIBLE SLICKLINE STUFFING BOX

(71) Applicant: SCHLUMBERGER TECHNOLOGY CORPORATION, Sugar Land, TX (US)

(72) Inventor: Prabhu Jagadesan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/104,376

(22) PCT Filed: Sep. 26, 2023

(86) PCT No.: PCT/US2023/033673

§ 371 (c)(1),
(2) Date: Feb. 18, 2025

(87) PCT Pub. No.: WO2024/072776

PCT Pub. Date: Apr. 4, 2024

(65) Prior Publication Data

US 2025/0257627 A1 Aug. 14, 2025

Related U.S. Application Data

(60) Provisional application No. 63/377,867, filed on Sep. 30, 2022.

(51) Int. Cl.
*E21B 33/072* (2006.01)
*E21B 34/14* (2006.01)

(52) U.S. Cl.
CPC ..... *E21B 33/072* (2013.01); *E21B 34/14* (2013.01)

(58) Field of Classification Search
CPC ..... E21B 34/14; E21B 33/072; E21B 33/076
See application file for complete search history.

(56) References Cited

U.S. PATENT DOCUMENTS 3,468,549 A 9/1969 Wilson
3,762,725 A * 10/1973 Taylor ..... F16J 15/185 277/330

(Continued)

FOREIGN PATENT DOCUMENTS

KR 102032129 B1 10/2019
WO 2011134637 A1 11/2011

(Continued)

OTHER PUBLICATIONS

International Search Report and Written Opinion of International Patent Application No. PCT/US2023/033673 dated on Jan. 18, 2024, 11 pages.

(Continued)

*Primary Examiner* — Dany E Akakpo
(74) *Attorney, Agent, or Firm* — Jeffrey D. Frantz

(57) ABSTRACT

A slickline stuffing box includes a piston configured to move in response to a force exerted thereon by a pressurized fluid. The slickline stuffing box also includes a packer element positioned above the piston. The packer element is configured to compress axially and expand radially, in response to movement of the piston, to seal around a slickline to contain a pressure within a wellbore during a slickline wellbore intervention. The slickline stuffing box also includes a valve configured to be positioned below the packer element in a first configuration of the slickline stuffing box and above the packer element in a second configuration of the slickline stuffing box. The valve is configured to contain the pressure within the wellbore in response to the slickline breaking and falling down and out of the slickline stuffing box.

16 Claims, 21 Drawing Sheets

(56) References Cited

U.S. PATENT DOCUMENTS

| | | | | |
|---|---|---|---|---|
| 4,266,605 | A | 5/1981 | LaBorde et al. | |
| 2011/0017444 | A1 | 1/2011 | McCollin | |
| 2013/0105141 | A1* | 5/2013 | Bernard | E21B 33/03 166/70 |

FOREIGN PATENT DOCUMENTS

| | | | |
|---|---|---|---|
| WO | 2019079404 | A1 | 4/2019 |
| WO | 2024072770 | A1 | 4/2024 |

OTHER PUBLICATIONS

International Search Report and Written Opinion of International Patent Application No. PCT/US2023/033664 dated on Jan. 16, 2024, 10 pages.

* cited by examiner

CONVERTIBLE SLICKLINE STUFFING BOX

CROSS-REFERENCE TO RELATED APPLICATION

This application is a National Stage Entry of International Application No. PCT/US2023/033673, filed Sep. 26, 2023, which claims priority to U.S. Provisional Patent Application No. 63/377,867, filed Sep. 30, 2022, the entirety of which is incorporated by reference herein.

BACKGROUND

A slickline refers to a single strand wire (e.g., a cable) that is used during drilling operations in the oil and gas industry to run a variety of tools down into and/or out of a wellbore. A slickline stuffing box provides a seal around the slickline when the tool is being run into and/or pulled out of the wellbore while performing a slickline well intervention. Conventional slickline stuffing boxes have a ball check valve (BCV) below a packer. However, some slickline jobs use the BCV above the packer, and conventional slickline stuffing boxes cannot be converted in the field to move the BCV above the packer.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A slickline stuffing box is disclosed. The slickline stuffing box includes a piston configured to move in response to a force exerted thereon by a pressurized fluid. The slickline stuffing box also includes a packer element positioned above the piston. The packer element is configured to compress axially and expand radially, in response to movement of the piston, to seal around a slickline to contain a pressure within a wellbore during a slickline wellbore intervention. The slickline stuffing box also includes a valve configured to be positioned below the packer element in a first configuration of the slickline stuffing box and above the packer element in a second configuration of the slickline stuffing box. The valve is configured to contain the pressure within the wellbore in response to the slickline breaking and falling down and out of the slickline stuffing box.

In another embodiment, the slickline stuffing box includes a housing defining an inner shoulder. The slickline stuffing box also includes a ball check valve (BCV) configured to be positioned at least partially within the housing. The BCV includes a ball. The slickline stuffing box also includes a retainer bushing configured to be positioned at least partially within the housing. The BCV is configured to be positioned vertically between the retainer bushing and the inner shoulder of the housing. A lower surface of the retainer bushing defines a downward-facing seat, and wherein the ball is configured to seal with the seat to contain a pressure within a wellbore in response to a slickline breaking and falling down and out of the slickline stuffing box. The slickline stuffing box also includes a cap configured to be positioned at least partially within the housing and at least partially around the retainer bushing. The slickline stuffing box also includes an upper body coupled to and positioned at least partially below the housing. The housing is positioned at least partially within the upper body. The slickline stuffing box also includes one or more packer elements positioned at least partially within the upper body. The slickline stuffing box also includes a lower body coupled to and positioned at least partially below the upper body. The slickline stuffing box also includes a piston positioned at least partially within the lower body. The slickline stuffing box also includes a biasing member positioned at least partially within the lower body. The slickline stuffing box also includes a port coupled to the lower body. The port provides a path of fluid communication between an exterior of the lower body and a chamber within the lower body. The piston moves and compresses the biasing member and the one or more packer elements in response to a fluid flowing into the chamber. The one or more packer elements expand radially in response to being compressed, which causes the one or more packer elements to seal around the slickline to contain the pressure within the wellbore during a slickline wellbore intervention.

A method is also disclosed. The method includes removing a first packer bushing from a slickline stuffing box. The method also includes removing a first packer element from the slickline stuffing box while the first packer bushing is removed without decoupling a sheave wheel assembly from the slickline stuffing box. The method also includes introducing a second packer element into the slickline stuffing box while the first packer bushing is removed and after the first packer element is removed.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
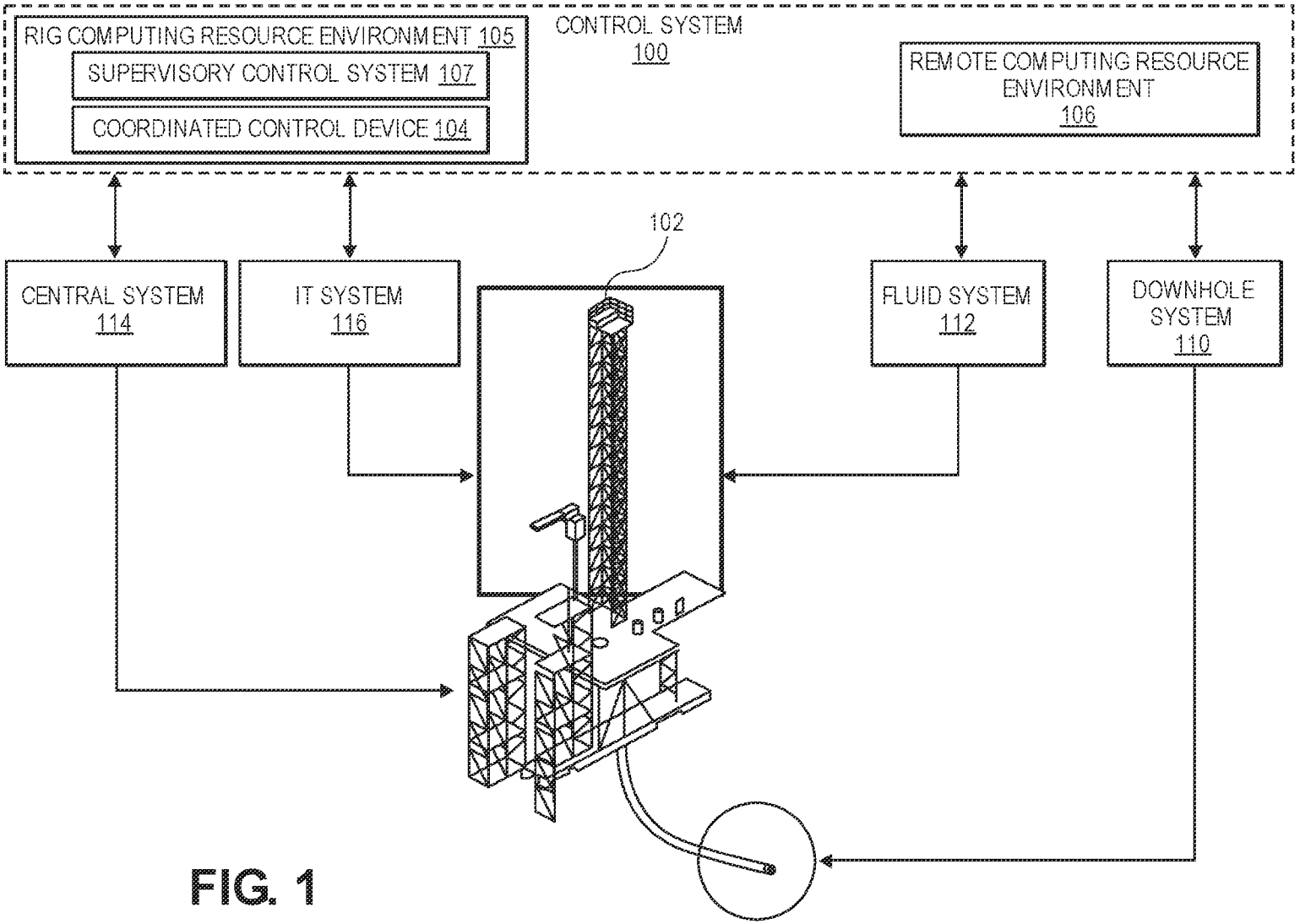
FIG. 1 illustrates a conceptual, schematic view of a control system for a drilling rig, according to an embodiment.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottomhole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114. e.g., such that the operation of the two or more rig systems 110, 112, 114 act in concert and/or off-design conditions in the rig systems 110, 112, 114 may be avoided.

Figure 2:
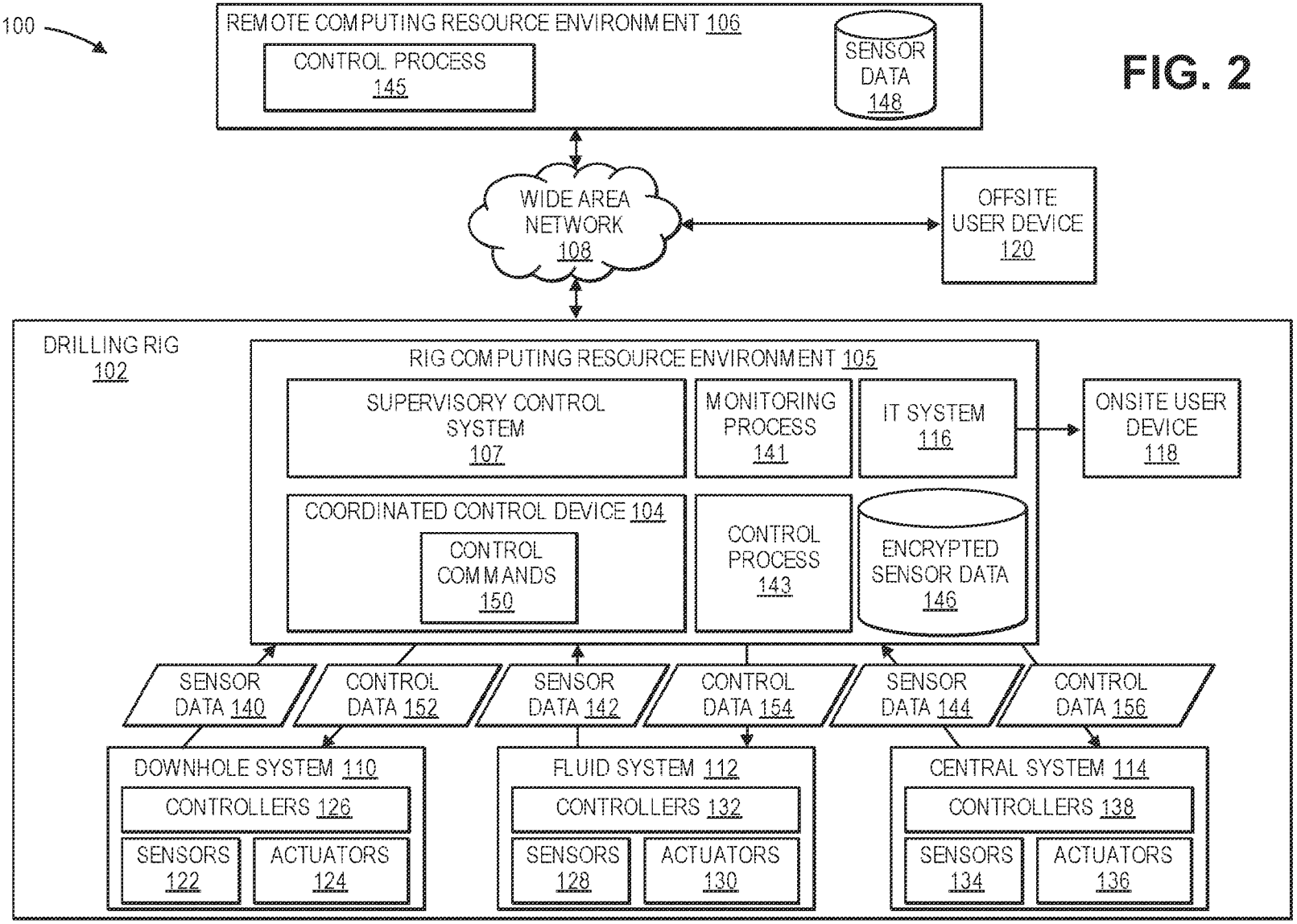
FIG. 2 illustrates a conceptual, schematic view of the control system, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 156 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110, 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Convertible Slickline Stuffing Box

The present disclosure includes a convertible slickline stuffing box. The slickline stuffing box is configured to be converted between a first configuration and a second configuration. In the first configuration, a valve may be positioned in a lower portion of the slickline stuffing box (e.g., below one or more packing elements), and in the second configuration, the valve may be positioned in an upper portion of the slickline stuffing box (e.g., above the one or more packing elements).

As described in greater detail below, a slickline may run through the slickline stuffing box, and a downhole tool may be coupled (i.e., rigged up) to a lower end of the slickline below the slickline stuffing box. The slickline and the downhole tool may be used to perform a slickline wellbore intervention in a wellbore. As used herein, a slickline wellbore intervention refers to an operation carried out in the wellbore during, or at the end of, its productive life that alters the state of the wellbore or wellbore geometry, provides wellbore diagnostics, and/or manages the production of the wellbore.

During the slickline wellbore intervention, the slickline stuffing box may be configured to form a seal around the slickline to control/contain the pressure in the wellbore below the seal. The valve may be in the first configuration to perform a first slickline wellbore intervention, and the valve may be converted into the second configuration to perform a second slickline wellbore intervention. The first and second slickline wellbore interventions may be different. In one embodiment, the slickline used during the first slickline wellbore intervention may be a non-digital slickline, and the slickline used during the second slickline wellbore intervention may be a digital slickline. The slickline wellbore interventions may be performed in any order. For example, the first slickline wellbore intervention may be performed before, after, and/or simultaneously with the second slickline wellbore intervention.

Figure 3A:
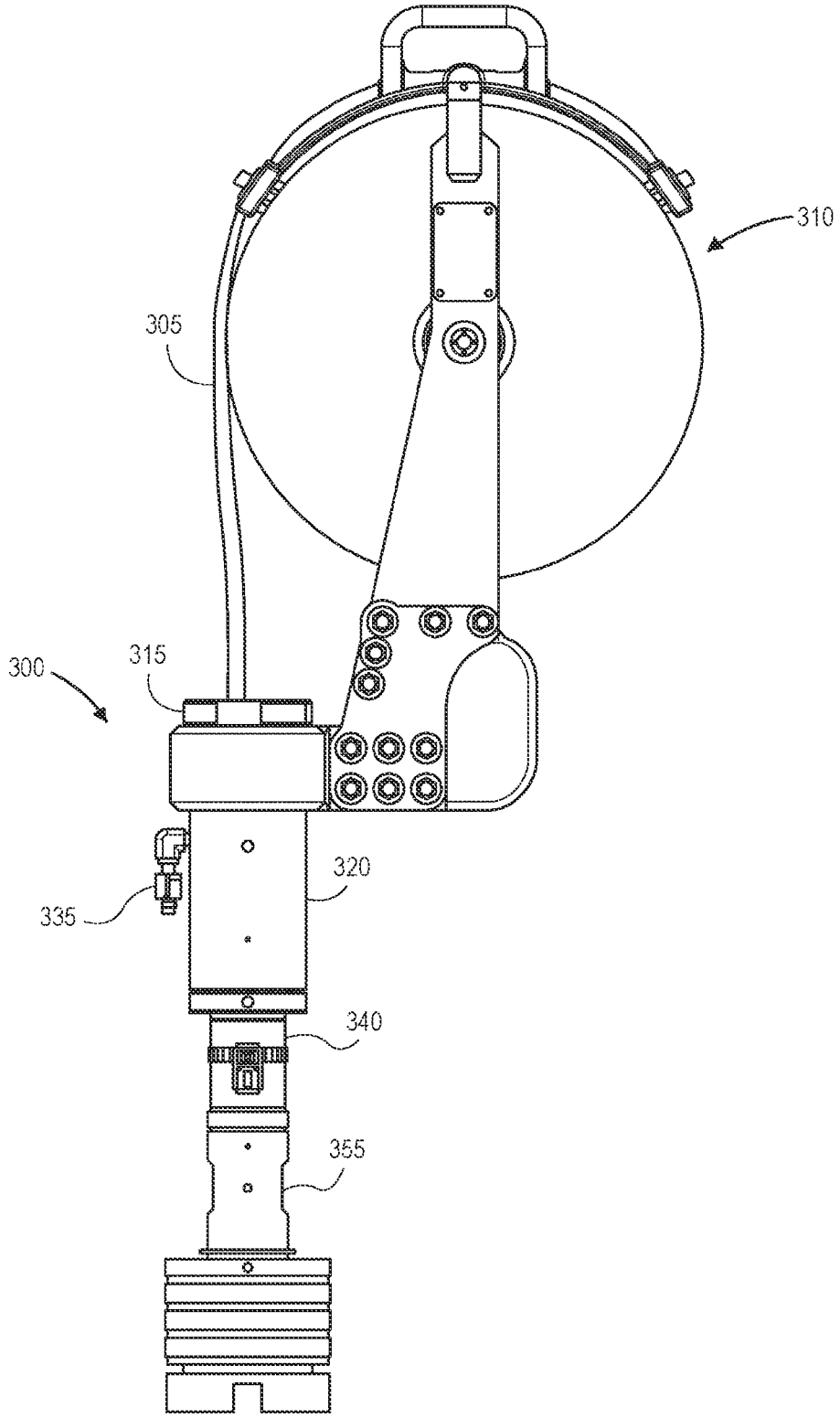
FIG. 3A illustrates a side view of a slickline stuffing box in a first configuration, according to an embodiment.
Figure 3B:
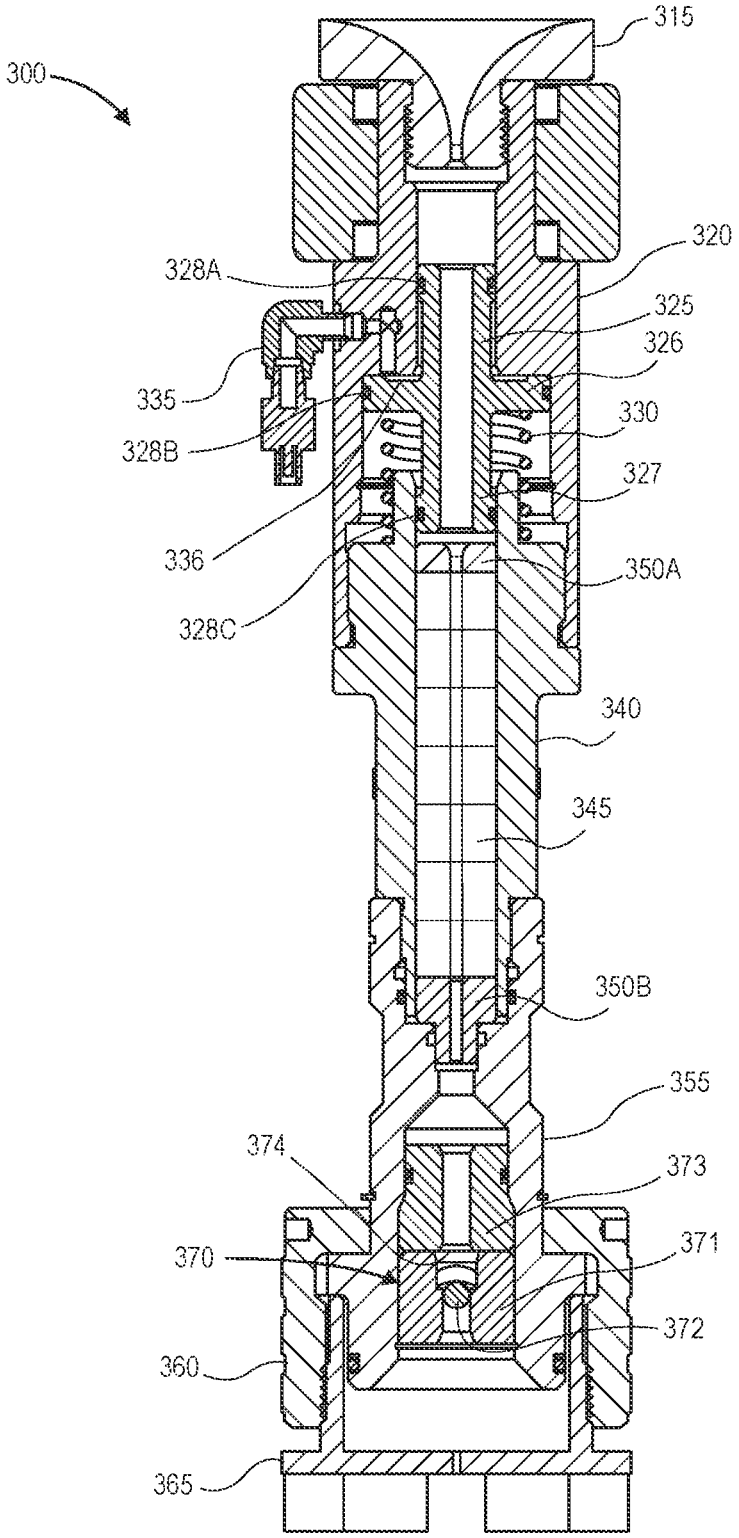
FIG. 3B illustrates a cross-sectional side view of the slickline stuffing box in the first configuration, according to an embodiment.

FIGS. 3A and 3B illustrate a side view and a cross-sectional side view of a slickline stuffing box 300 in a first configuration where a valve 370 is in a lower portion of the slickline stuffing box 300, according to an embodiment. The slickline stuffing box 300 may be positioned above a pressure control equipment (PCE) stack and a wellbore. A slickline 305 may extend (e.g., vertically) through the slickline stuffing box 300, the PCE stack, and into the wellbore.

The slickline 305 may be positioned at least partially around a sheave wheel assembly 310, as shown in FIG. 3A. The sheave wheel assembly 310 may be configured to rotate to run the slickline 305 (e.g., down) through the slickline stuffing box 300 and into the wellbore and/or to pull the slickline 305 (e.g., up) through the slickline stuffing box 300 and out of the wellbore.

A first (e.g., upper) end of the slickline stuffing box 300 may include an entry guide 315. The entry guide 315 may receive and guide a slickline 305 into the slickline stuffing box 300.

The slickline stuffing box 300 may also include a first (e.g., upper) body 320. The upper body 320 may be positioned at least partially below and/or around the entry guide 315. The sheave wheel assembly 310 may be coupled to the upper body 320.

The slickline stuffing box 300 may also include a piston 325 that is positioned at least partially within the upper body 320. The piston 325 may be configured to move/actuate (e.g., up and/or down) within the upper body 320 to form a seal around the slickline 305, as discussed in greater detail below. The piston 325 may be symmetric such that the piston 325 cannot be installed upside-down. More particularly, the shape of the piston 325 and the locations of one or more seals (three are shown: 328A-328C) positioned thereabout may be symmetric through a (e.g., horizontal) plane through a shoulder 326 of the piston 325.

The slickline stuffing box 300 may also include a biasing member (e.g., a spring) 330. The biasing member 330 may be positioned at least partially within the upper body 320. The biasing member 330 may also be positioned at least partially below a shoulder 326 of the piston 325 and/or around a lower stem 327 of the piston 325. The biasing member 330 may be configured to compress and/or expand. More particularly, as the biasing member 330 is compressed, it may exert an increasing axial (e.g., upward) force on the piston 325.

The slickline stuffing box 300 may also include a port (also referred to as an operating port) 335. The port 335 may be coupled to and/or part of the upper body 320. In one embodiment, a pressurized fluid may be introduced through the port 335 and into the upper body 320 (e.g., above the shoulder of the piston 325). As described in greater detail below, when introduced through the port 335, the fluid may push the piston 325 downward, which may form a seal around the slickline 305 during a slickline wellbore intervention. After the slickline wellbore intervention, the fluid may flow back out of the slickline stuffing box 300 through the port 335.

The slickline stuffing box 300 may also include a packer housing 340. The packer housing 340 may be positioned at least partially below the upper housing 320, the piston 325, the biasing member 330, and/or the port 335. At least a portion of the packer housing 340 may be positioned radially inward from the upper body 320 and radially outward from the piston 325. The packer housing 340 may be coupled (e.g., threaded) to the upper housing 320. The packer housing 340 may guide (e.g., the lower stem 327 of) the piston 325 as the piston 325 moves. The packer housing 340 may also contain the wellbore pressure.

The slickline stuffing box 300 may also include one or more packer elements 345. For example, there may be seven 1-inch packer elements 345. More particularly, the packer elements 345 may be positioned at least partially within the packer housing 340. The slickline 305 may extend through the packer elements 345. The packer elements 345 may be or include elastomeric (e.g., rubber) elements that are configured to compress in response to the piston 325 moving downward. The packer elements 345 may expand radially (e.g., inward and/or outward) when compressed. This radial expansion may allow the packer elements 345 to create a static and/or dynamic seal with the outer surface of the slickline 305 and/or the inner surface of the packer housing 340. In one embodiment, one or more (e.g., brass) bushings 350A, 350B may be positioned at least partially within the packer housing 340 and at least partially above and/or below the packer elements 345 to prevent the packer elements 345 from extruding axially out of the packer housing 340.

The slickline stuffing box 300 may also include a second (e.g., lower) body 355. The lower body 355 may be positioned at least partially below and/or at least partially around the packer housing 340. The lower body 355 may be coupled (e.g., threaded) to the packer housing 340. The upper body 320, the packer housing 340, and the lower body 355 may contain the pressure of the fluid therein (i.e., the wellbore pressure). The lower body 355 may include a pin connection with a collar 360 that is configured to be connected to a box connection on other equipment (e.g., a thread protector and/or PCE) 365 positioned below the lower body 355.

The slickline stuffing box 300 may also include a valve 370. The valve 370 may be or include a ball check valve (BCV) including a valve body 371, a ball 372 within the valve body 371, and a retainer 373. The retainer 373 may include or define a downward-facing seat 374 that is configured to receive the ball 372 when the wellbore pressure pushes the ball 372 upward. The ball 372 may form a seal against the seat 374 to control/contain the wellbore pressure therebelow.

The slickline 305 may extend through the valve 370. The valve 370 may be configured to create a wellbore seal if/when the slickline 305 breaks and falls down and out of the slickline stuffing box 300 (e.g., to prevent the wellbore pressure from being released up through the slickline stuffing box 300).

In the embodiment shown, where the slickline stuffing box 300 is in the first configuration, the valve 370 may be positioned in the lower portion of the slickline stuffing box 300. More particularly, the valve 370 may be positioned below the packer housing 340 and the packer elements 345 and at least partially within the lower body 355. The valve 370 may be in this position when the first slickline wellbore intervention is performed. In an example, the first slickline wellbore intervention may use a first (e.g., non-digital) slickline 305 to perform well intervention operations such as capturing one or more measurements in the wellbore with the downhole tool, setting a plug in the wellbore, pulling the plug in the wellbore, fishing for an object at the bottom or the wellbore, or the like. In one embodiment, the non-digital slickline 305 may not be configured to communicate with equipment at the surface.

Figure 4A:
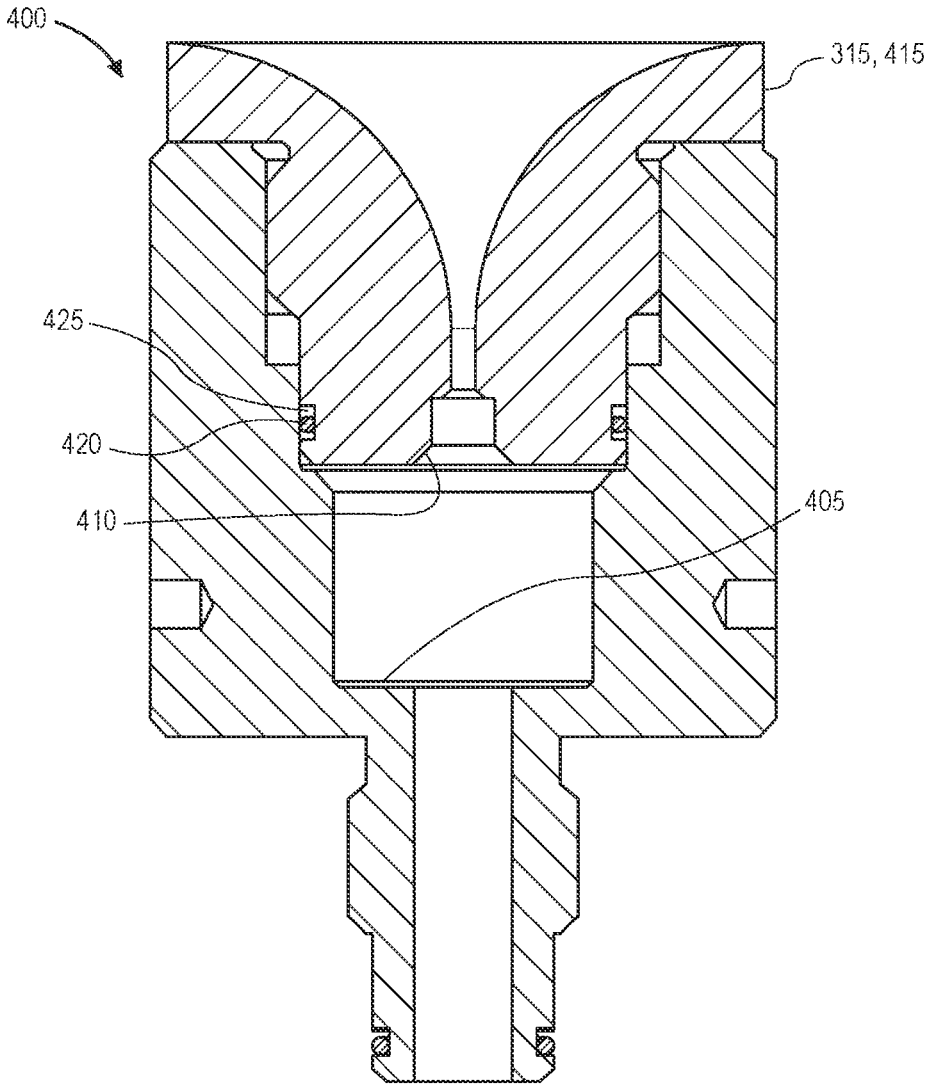
FIG. 4A illustrates a cross-sectional side view of a conversion housing that is configured to be positioned at least partially in and/or coupled to the slickline stuffing box, according to an embodiment.
Figure 4B:
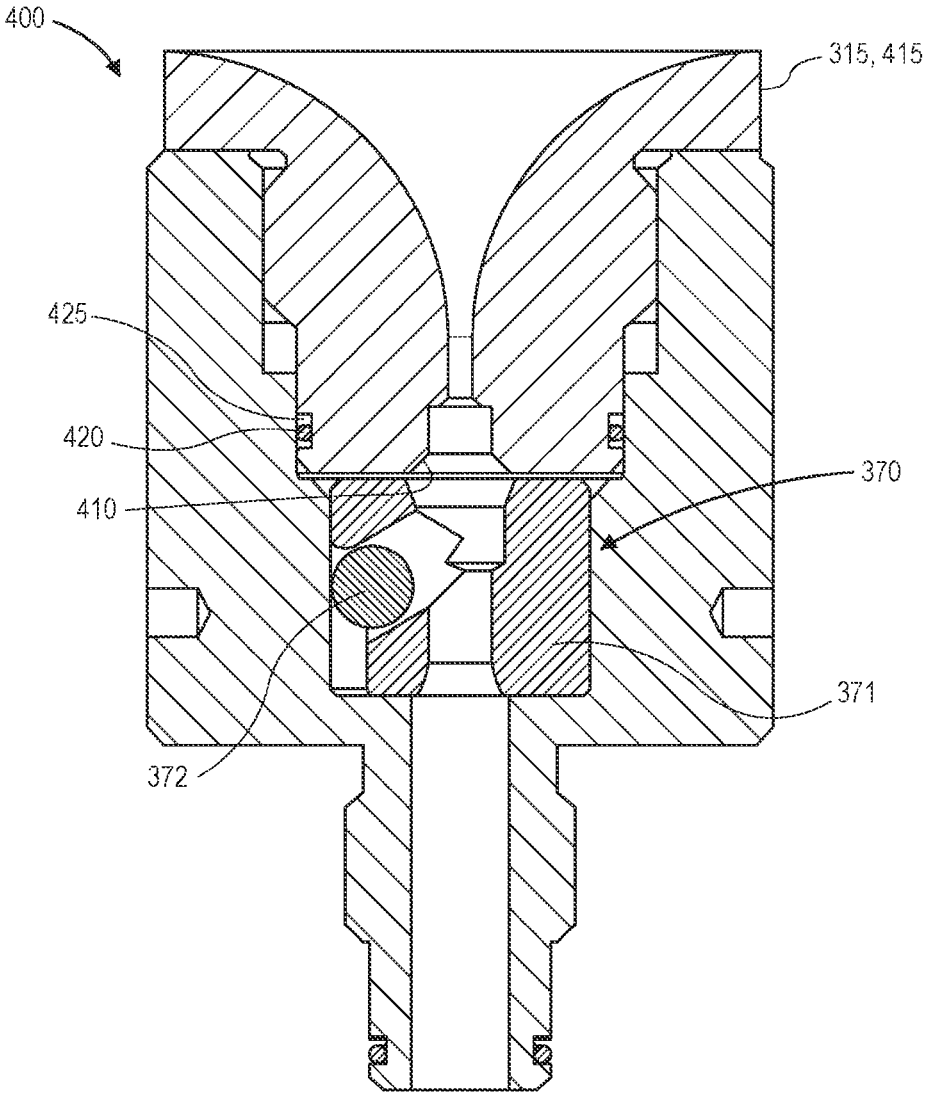
FIG. 4B illustrates a cross-sectional side view of the conversion housing with a valve positioned therein, according to an embodiment.

FIG. 4A illustrates a cross-sectional side view of a conversion housing 400 that is configured to be coupled to and/or positioned at least partially within the slickline stuffing box 300, and FIG. 4B illustrates the conversion housing 400 with the valve 370 positioned therein, according to an embodiment. The conversion housing 400 may include or define a lower shoulder 405, and the valve 370 may be configured to sit on the shoulder 405. In one embodiment, the conversion housing 400 may be positioned at least partially below the entry guide 315 (FIGS. 3A and 3B), and the entry guide 315 may act as the retainer for the valve 370. In another embodiment, the entry guide 315 may be removed or omitted, and the conversion housing 400 may include a different entry guide (also referred to as a bell or cap) 415 that acts as a retainer for the valve 370. In other words, the valve 370 may be secured (e.g., vertically) between the shoulder 405 and the entry guide 315, 415.

The entry guide 315, 415 may include or define a downward-facing seat 410 that is configured to receive the ball 372 when the wellbore pressure pushes the ball 372 upward. The ball 372 may form a seal against the seat 410 to control/contain the wellbore pressure therebelow. One or more seals (e.g., O-rings) 420 and/or one or more backup rings 425 may be positioned at least partially radially between the conversion housing 400 and the entry guide 315, 415.

Figure 5A:
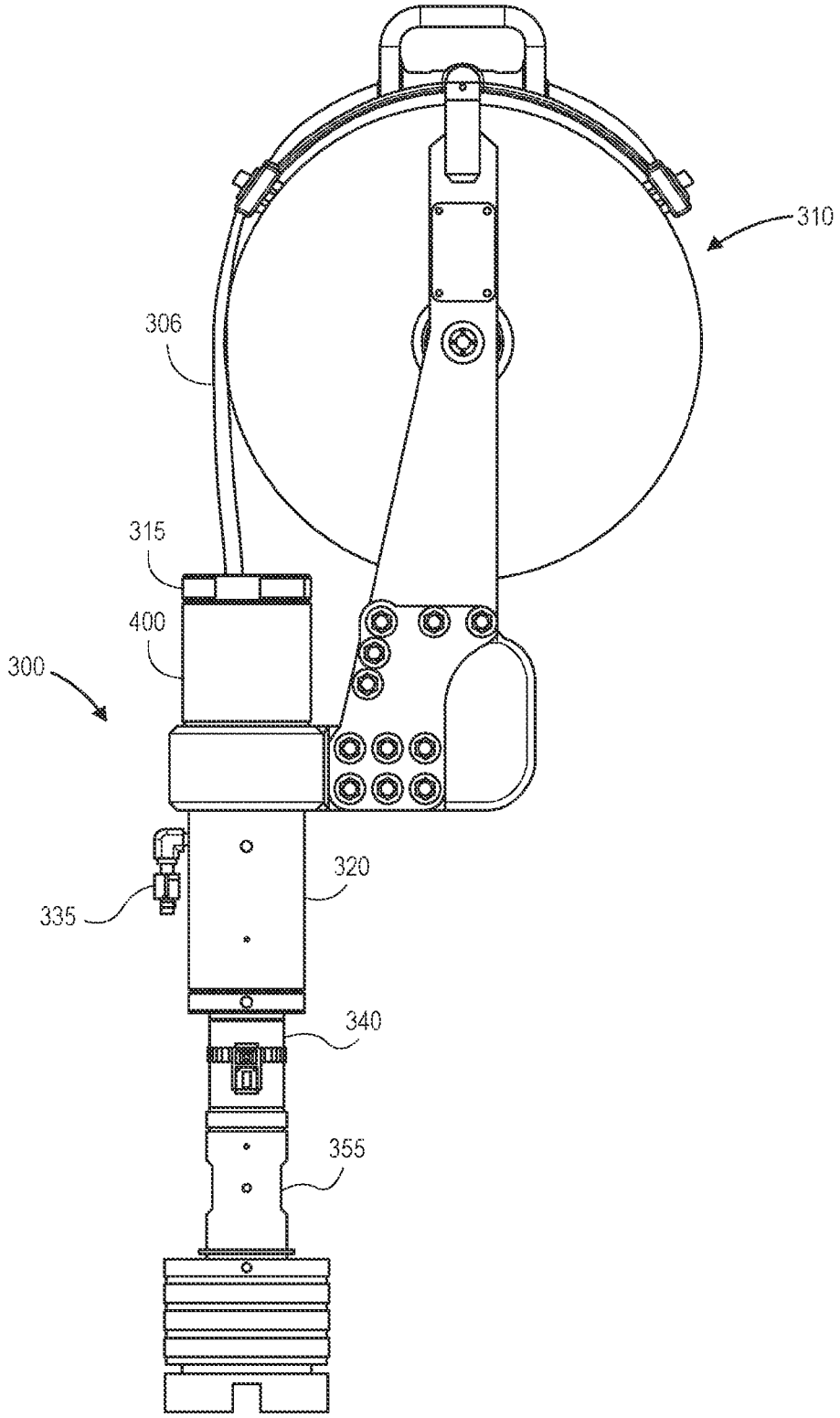
FIG. 5A illustrates a side view of the slickline stuffing box in a second configuration, according to an embodiment.
Figure 5B:
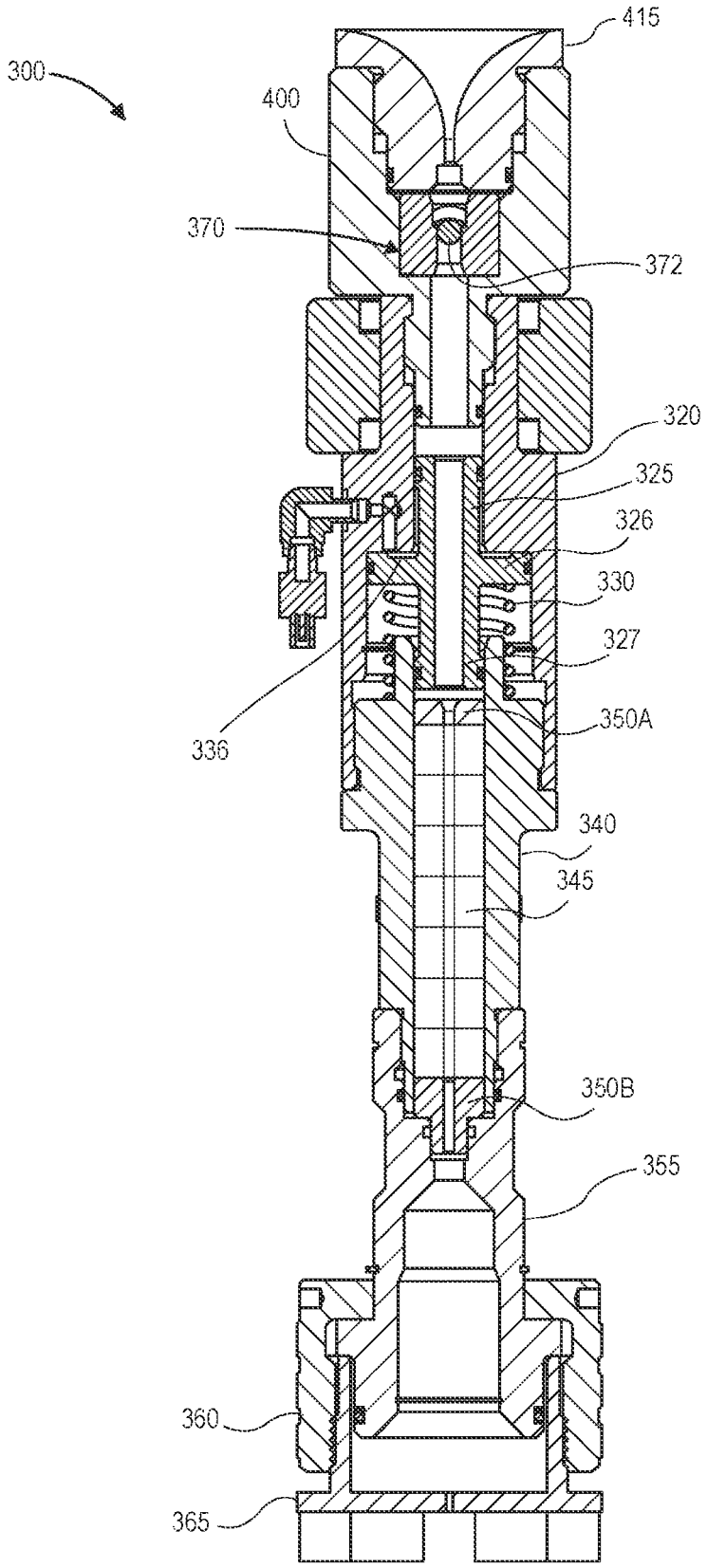
FIG. 5B illustrates a cross-sectional side view of the slickline stuffing box in the second configuration, according to an embodiment.

FIGS. 5A and 5B illustrate a side view and a cross-sectional side view of the slickline stuffing box 300 in a second configuration, according to an embodiment. In the second configuration, the valve 370 may be moved/relocated proximate to an upper portion of the slickline stuffing box 300. To accomplish this, the entry guide 315 may be removed, and the conversion housing 400 may be positioned above and/or at least partially within the upper body 320. For example, the conversion housing 400 may include outer threads that are configured to engage inner threads of the upper body 320.

The valve 370 may be positioned at least partially within the conversion housing 400. The entry guide 315 or 415 may be positioned above and/or at least partially within the conversion housing 400. As mentioned above, the valve 370 may be secured (e.g., vertically) between the shoulder 405 of the conversion housing 400 and the entry guide 315 or 415. Thus, the conversion housing 400 may allow the valve 370 to be moved/relocated to be above the packer housing 340 and the packer elements 345. The valve 370 may be in this position when the second slickline wellbore intervention is performed. In an example, the second slickline wellbore intervention may use a second (e.g., digital) slickline 306 to perform well intervention operations such with a downhole tool that is configured to communicate with equipment at the surface (e.g., real-time telemetry) using the digital slickline 306. The digital slickline 306 (FIG. 5B) may differ from the slickline 305 (FIG. 3A) in that the digital slickline 306 may include a cable that is configured to transmit communication signals to and/or from the surface. The digital slickline 306 may also include a protective coating around the cable.

Figure 6A:
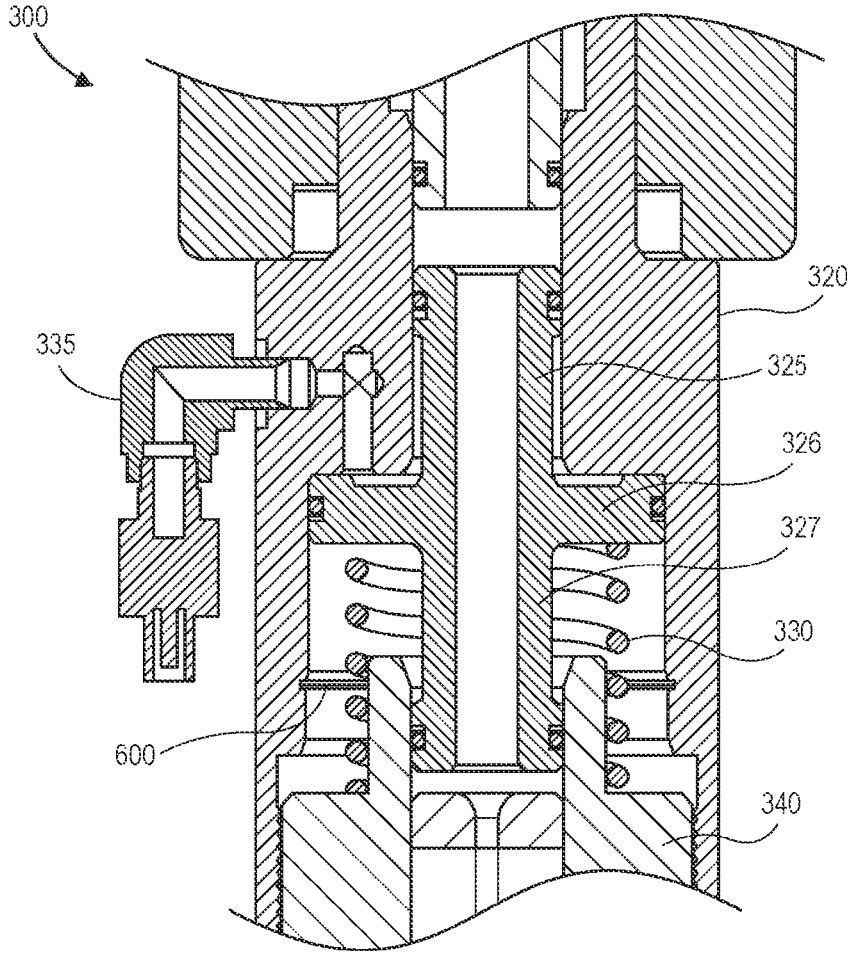
FIG. 6A illustrates a cross-sectional side view of a portion of the slickline stuffing box showing a piston, a biasing member, and a port, according to an embodiment.
Figure 6B:
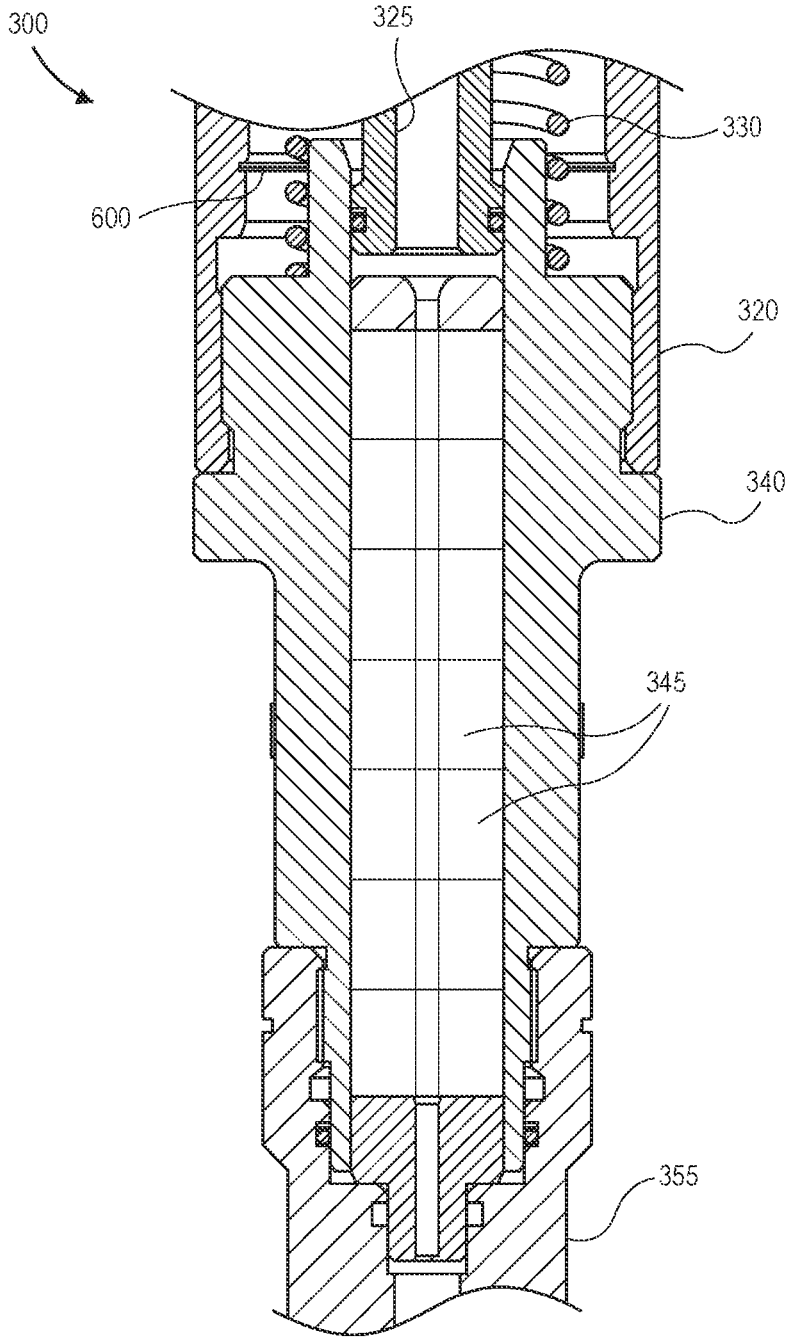
FIG. 6B illustrates a cross-sectional side view of a portion of the slickline stuffing box showing a packer housing and packer elements, according to an embodiment.

FIG. 6A illustrates a cross-sectional side view of a portion of the slickline stuffing box 300 showing the piston 325, the biasing member 330, and the port 335, and FIG. 6B illustrates a cross-sectional side view of a portion of the slickline stuffing box 300 showing the packer housing 340 and the packer elements 345, according to an embodiment. A pressurized fluid may be introduced through the port 335 and into the upper body 320 above the shoulder of the piston 325. The pressure of the fluid may be, for example, from about 100 PSI to about 5000 PSI or from about 1000 PSI to about 4000 PSI (e.g., about 3000 PSI). This may be referred to as the operating pressure. The operating pressure may be greater than, less than, or equal to the pressure of the fluid in the wellbore (referred to as the wellbore pressure), which may be, for example, from about 6000 PSI to about 12.000 PSI or from about 8000 PSI to about 11,000 PSI (e.g., about 10,000 PSI).

The pressurized fluid may exert a downward force on the piston 325, which causes the piston 325 to move downwards within the upper body 320. The downward movement compresses the biasing member 330. The downward movement also compresses the packer elements 345 within the packer housing 340, which causes the packer elements 345 to expand radially inward and/or outward. As mentioned above, this expansion causes the packer elements 345 to form a (e.g., static and/or dynamic) seal with the slickline 305 and/or the packer housing 340 (e.g., during a slickline wellbore intervention).

After the slickline wellbore intervention, the operating pressure may be reduced (e.g., through the port 335), which allows the biasing member 330 to push the piston 325 back up. One or more snap rings 600 may prevent the piston 325 from falling off during replacement of the packer elements 345. The packer housing 340 may include an open bottom to facilitate removal and/or replacement of the packer elements 345.

Figure 6C:
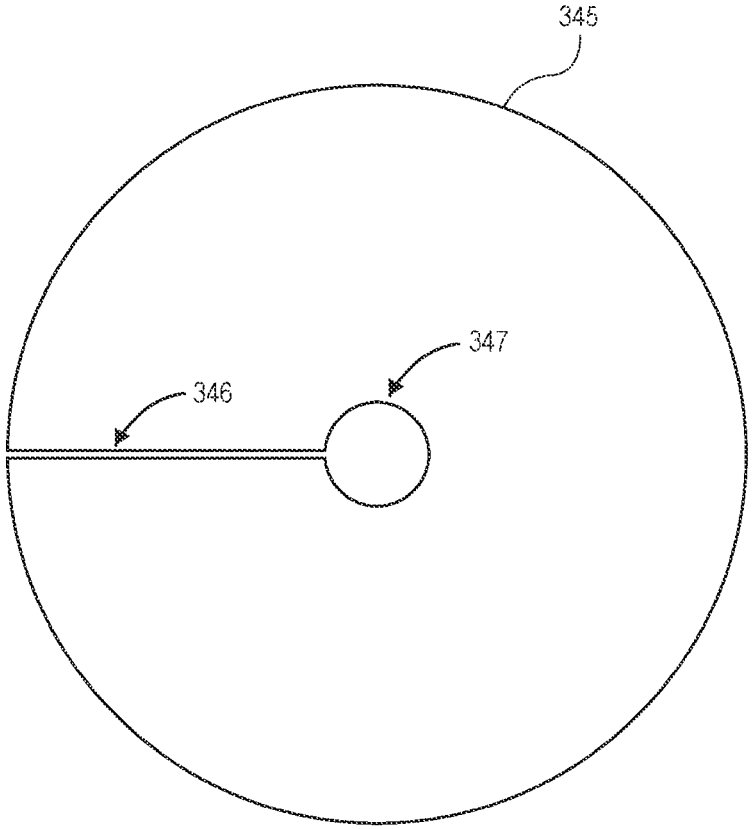
FIG. 6C illustrates atop view of the packer elements, according to an embodiment.

FIG. 6C illustrates a top view of the packer elements 345, according to an embodiment. The packer elements 345 may include a circumferential slot 346 that may facilitate removing, replacing, and/or installing the packer elements 345 while the slickline 305 is present. For example, the slickline 305 may slide radially through the slot 346 to a center portion 347 of the packer element 345.

Figure 7A:
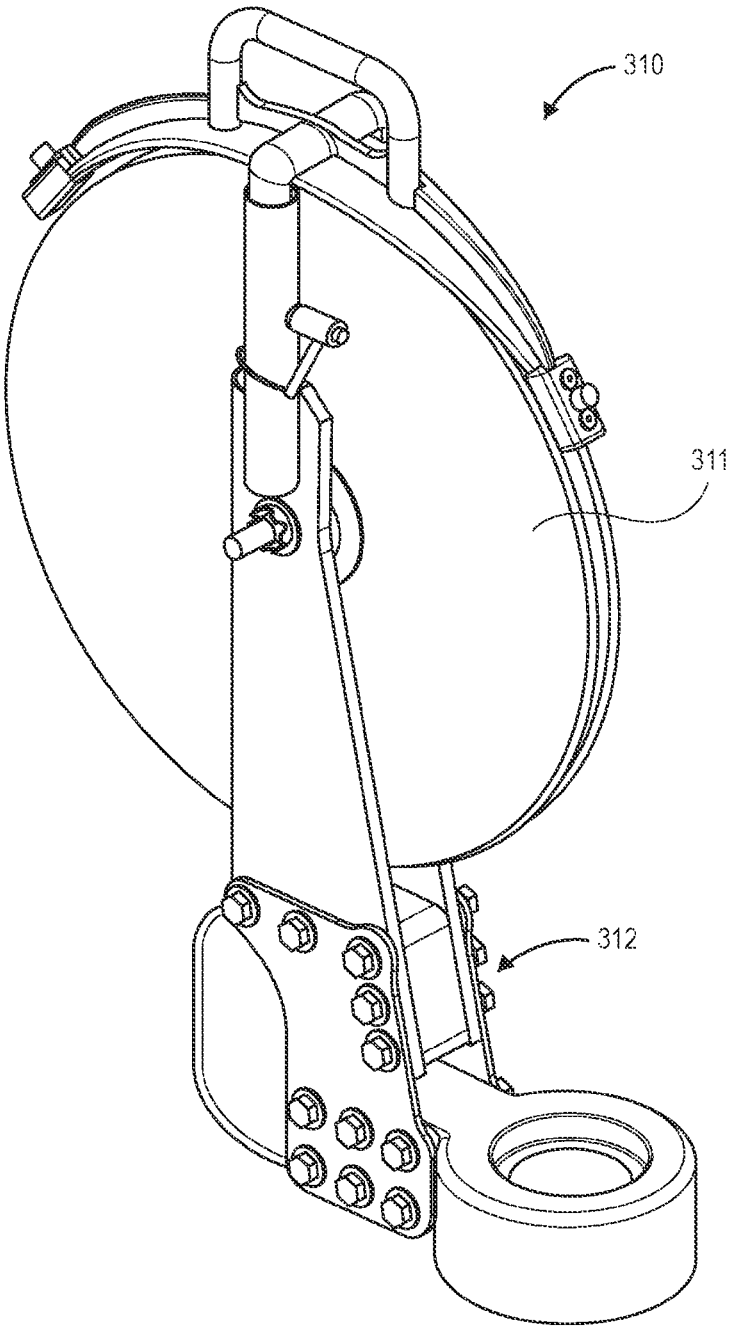
FIG. 7A illustrates a perspective view of a sheave wheel assembly, according to an embodiment.

FIG. 7A illustrates a perspective view of the sheave wheel assembly 310, according to an embodiment. The sheave wheel assembly 310 may have a wheel 311 with a 16-inch diameter. The sheave wheel assembly 310 may also have a bracket assembly 312 that is configured to be coupled to the upper body 320.

Figure 7B:
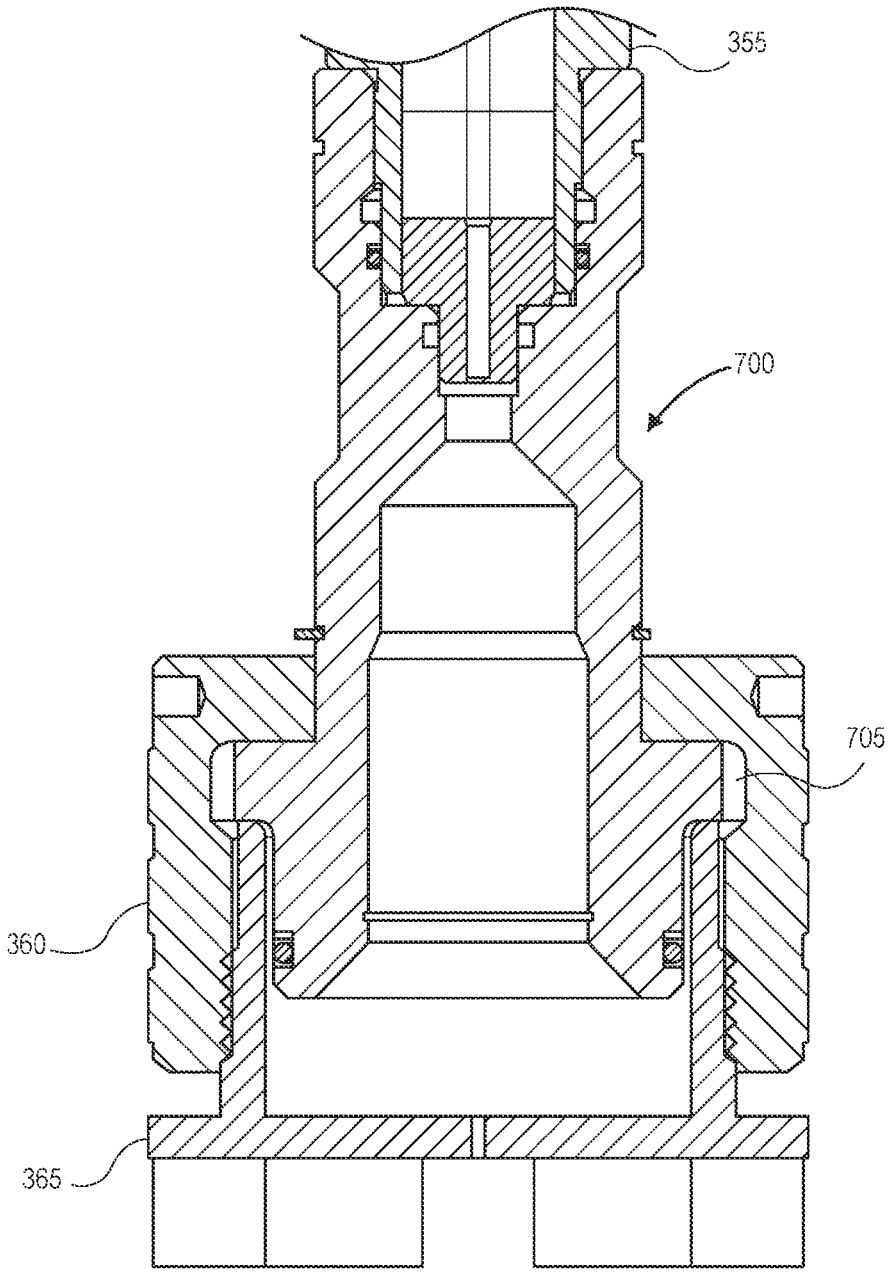
FIG. 7B illustrates a cross-sectional side view of an adapter positioned at least partially within the slickline stuffing box, according to an embodiment.

FIG. 7B illustrates a cross-sectional side view of an adapter 700 that is configured to be positioned at least partially within the slickline stuffing box 300, according to an embodiment. As shown, the adapter 700 may be positioned at least partially around and/or below the lower body 355. The adapter 700 may include a (e.g., 3-inch) pin end 705 that is configured to engage with a tool catcher or other well intervention equipment (e.g., PCE). In another embodiment, the pin end 705 of the adapter 700 may instead be larger (e.g., 5-inches) to engage with a box end of a lubricator without changes to any other components.

Figure 8:
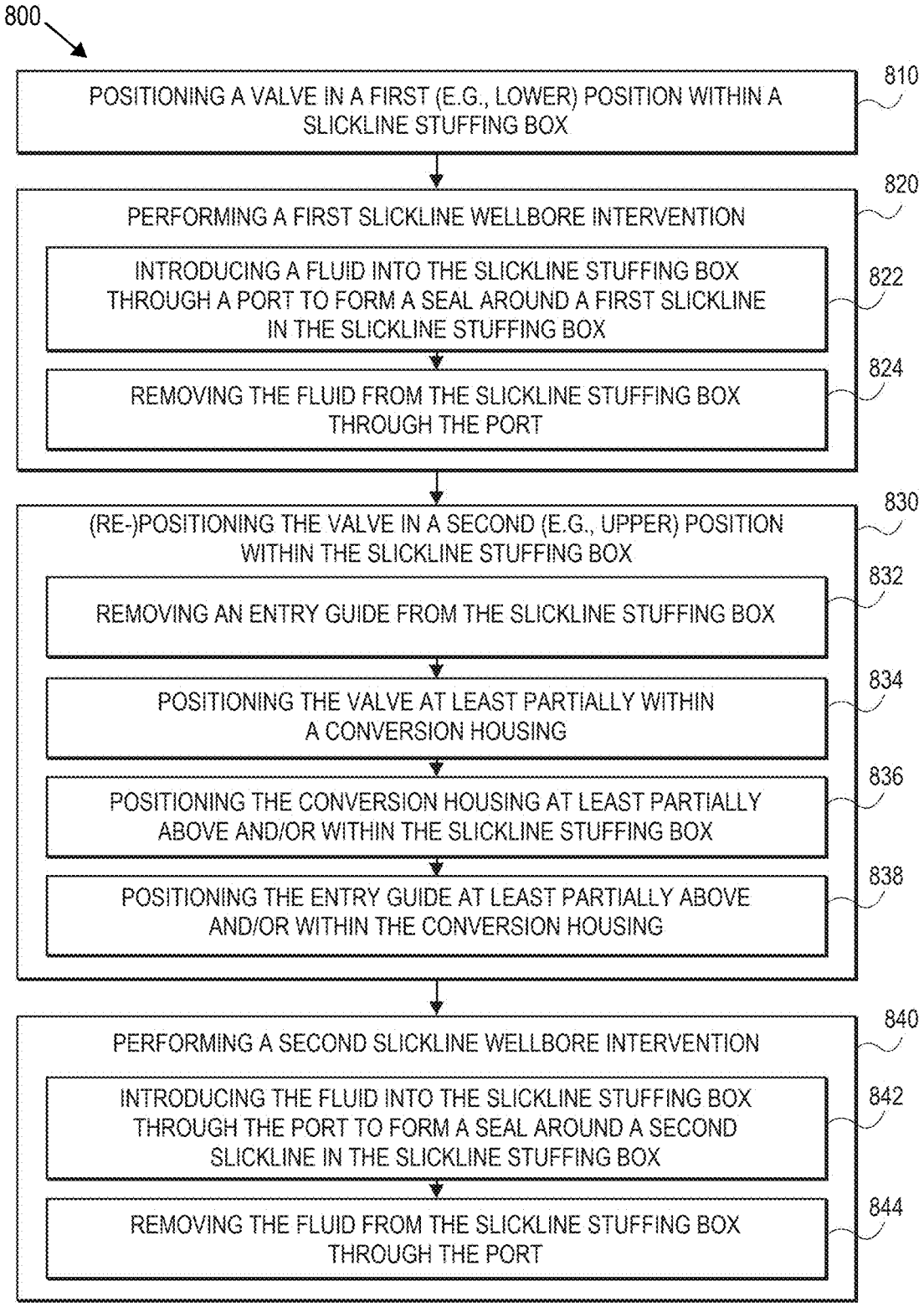
FIG. 8 illustrates a flowchart of a method for converting the slickline stuffing box to move the valve from a first (e.g., lower) position to a second (e.g., upper) position, according to an embodiment.

FIG. 8 illustrates a flowchart of a method 800 for converting the slickline stuffing box 300 and/or performing a slickline wellbore intervention, according to an embodiment. An illustrative order of the method 800 is provided below; however, one or more portions of the method 800 may be performed in a different order, combined, repeated, or omitted.

The method 800 may include positioning the valve 370 in a first (e.g., lower) position within the slickline stuffing box 300, as at 810. This is shown in FIGS. 3A and 3B. The first position may be below the packer housing 340 and/or the packer elements 345. The first position may also or instead be at least partially within the lower body 355.

The method 800 may also include performing a first slickline wellbore intervention, as at 820. The first slickline wellbore intervention may be performed using a first (e.g., non-digital) slickline 305 while the valve 370 is in the first position.

Performing the first slickline wellbore intervention may include introducing a fluid into the slickline stuffing box 300 through the port 335, as at 822. The fluid may be introduced into a chamber that is defined at least partially by the upper body 320 and the (e.g., shoulder 326 of the) piston 325. The fluid may have a pressure such that when the fluid is introduced into the chamber, the fluid exerts a downward force on the piston 325 that exceeds an upward force exerted on the piston 325 by the biasing member 330. As a result, the piston 325 moves downward, which compresses the biasing member 330 and the packer elements 345. As mentioned above, compressing the packer elements 345 may create a static and/or dynamic seal with the outer surface of the slickline 305 and/or the inner surface of the packer housing 340. This seal may allow the first slickline wellbore intervention to take place in the wellbore.

Performing the first slickline wellbore intervention may also include removing the fluid from the slickline stuffing box 300 through the port 335, as at 824. For example, after the first slickline wellbore intervention has occurred, the fluid may flow out of the chamber through the port 335. This may allow the biasing member 330 to push the piston 325 back upward, which decompresses the biasing member 330 and the packer elements 345.

The method 800 may also include (re-)positioning the valve 370 in a second (e.g., upper) position within the slickline stuffing box 300, as at 830. This is shown in FIGS. 5A and 5B. The second position may be above the packer housing 340 and/or the packer elements 345. The second position may also or instead be above the upper body 320. In one embodiment, the valve 370 may be (re-)positioned at the same wellbore and/or the same wellsite where the first slickline wellbore intervention occurred. In another embodiment, the valve 370 may be (re-)positioned at a different wellbore and/or a different wellsite than where the first slickline wellbore intervention occurred.

Positioning (or re-positioning) the valve 370 may include removing the entry guide 315, as at 832. More particularly, the entry guide 315 may be removed from the upper body 320.

Positioning (or re-positioning) the valve 370 may also include positioning the valve 370 at least partially within the conversion housing 400, as at 834. More particularly, the valve 370 may be positioned on and/or above (or otherwise in contact with) the shoulder 405 in the conversion housing 400.

Positioning (or re-positioning) the valve 370 may also include positioning the conversion housing 400 at least partially above and/or within the slickline stuffing box 300, as at 836. More particularly, the conversion housing 400 may be positioned at least partially above and/or within the upper body 320. For example, the conversion housing 400 may have outer threads that are configured to engage with inner threads of the upper housing 320.

Positioning (or re-positioning) the valve 370 may also include positioning the entry guide 315 (or another entry guide 415) at least partially above and/or within the conversion housing 400, as at 838. The valve 370 may be secured (e.g., vertically) between the shoulder 405 in the conversion housing 400 and the entry guide 315, 415.

The method 800 may also include performing a second slickline wellbore intervention, as at 840. The second intervention may be performed using a second (e.g., digital) slickline 306 while the valve 370 is in the second position. As mentioned above, the second slickline wellbore intervention may be performed before, simultaneously with, or after the first slickline wellbore intervention.

Performing the second slickline wellbore intervention may include introducing the fluid into the slickline stuffing box 300 through the port 335, as at 842. The fluid may be introduced into the chamber that is defined at least partially by the upper body 320 and the (e.g., shoulder 326 of the) piston 325. The fluid may have a pressure such that when the fluid is introduced into the chamber, the fluid exerts a downward force on the piston 325 that exceeds an upward force exerted on the piston 325 by the biasing member 330. As a result, the piston 325 moves downward, which compresses the biasing member 330 and the packer elements 345. As mentioned above, compressing the packer elements 345 may create a static and/or dynamic seal with the outer surface of the slickline 305 and/or the inner surface of the packer housing 340. This seal may allow the second slickline wellbore intervention to take place.

Performing the second slickline wellbore intervention may also include removing the fluid from the slickline stuffing box 300 through the port 335, as at 844. For example, after the second slickline wellbore intervention has occurred, the fluid may flow out of the chamber through the port 335. This may allow the biasing member 330 to push the piston 325 back upward, which decompresses the biasing member 330 and the packer elements 345.

Convertible Slickline Stuffing Box with Easy Packer Change

Figure 9A:
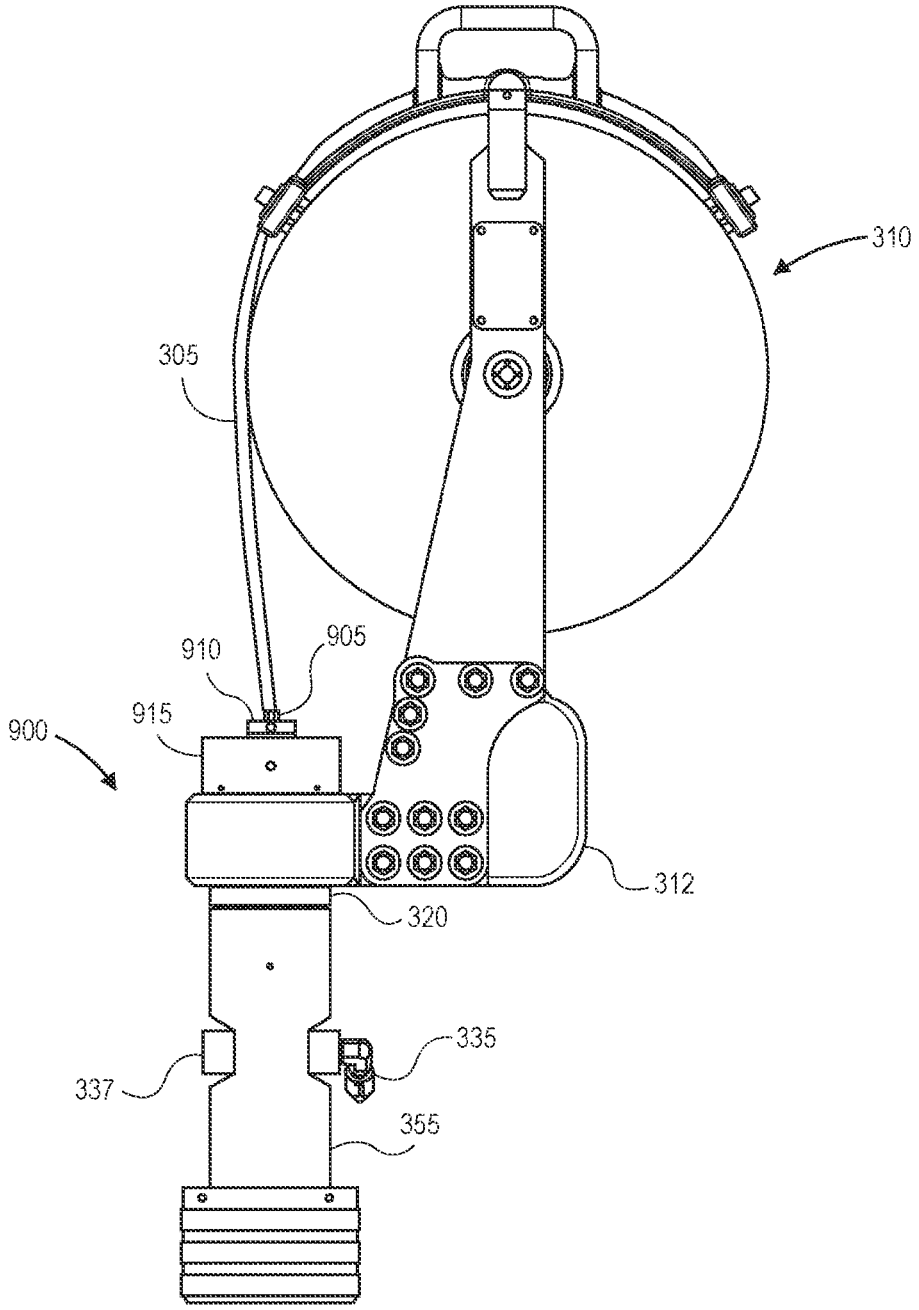
FIG. 9A illustrates a side view of another slickline stuffing box in a first configuration, according to an embodiment.
Figure 9B:
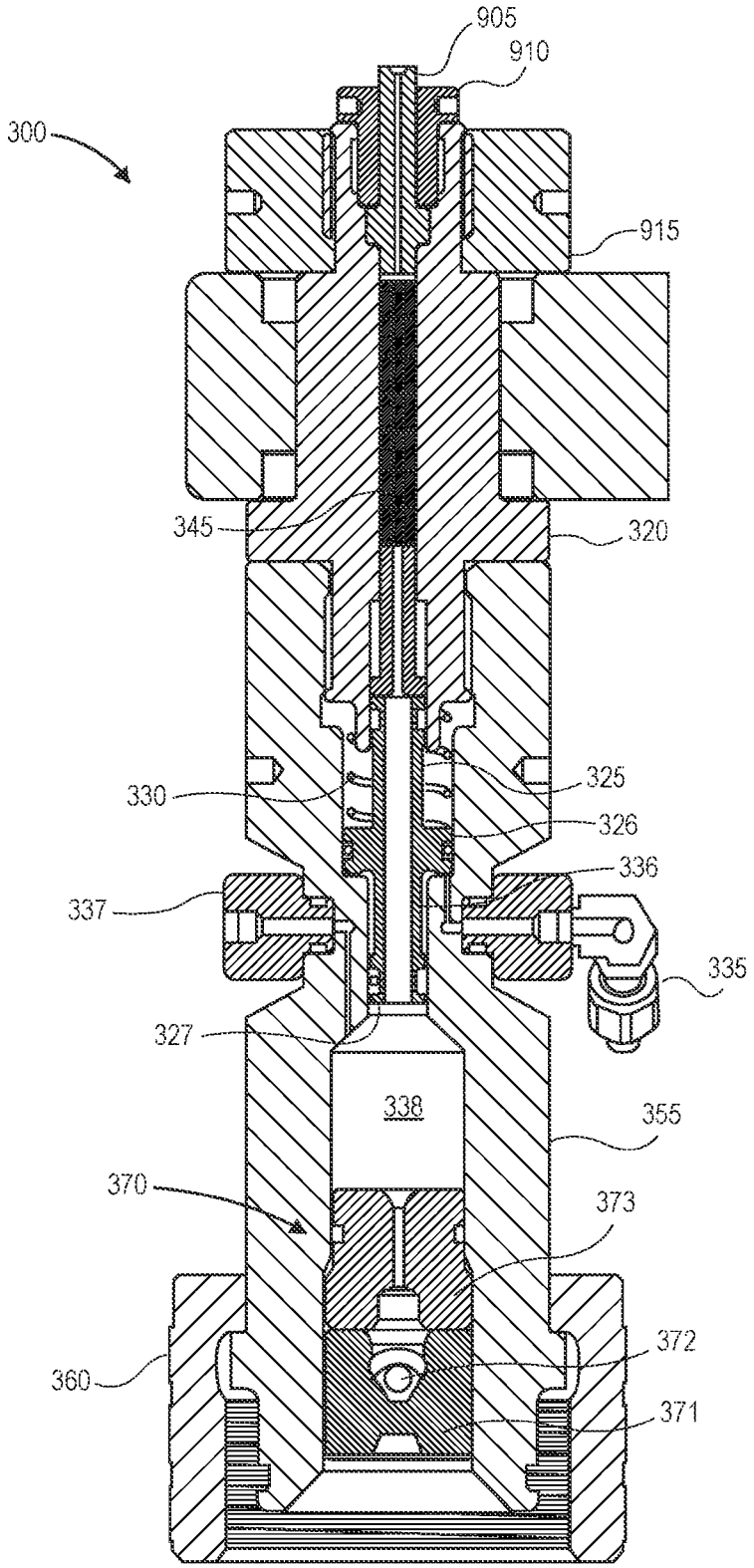
FIG. 9B illustrates a cross-sectional side view of the slickline stuffing box in the first configuration, according to an embodiment.

FIGS. 9A and 9B illustrate a side view and a cross-sectional side view of another slickline stuffing box 900 in a first configuration where the valve 370 is in a lower portion of the slickline stuffing box 900, according to an embodiment. The slickline stuffing box 900 may be similar to the slickline stuffing box 300, and the same reference numbers are used where applicable. For example, the slickline stuffing box 900 may include the sheave wheel assembly 310, the upper body 320, the piston 325, the biasing member 330, the port 335, the packer elements 345, the lower body 355, the collar 360, the valve 370, or a combination thereof.

In the embodiment shown, the packer housing 340 (see FIGS. 3A and 3B) may be omitted, and the packer elements 345 may instead be positioned in the upper body 320. In addition, the piston 325 and/or the biasing member 330 may be positioned at least partially in the lower body 355. The port 335 may also be coupled to the lower body 355. The pressurized fluid may be introduced through the port 335 and into the chamber 336 (e.g., now defined by the lower surface of the shoulder 326 of the piston 325 and the lower body 355), which may push the piston 325 upward.

Introducing the pressurized fluid into the chamber 336 may compress the packer elements 345 to form a seal around the slickline 305 during a slickline wellbore intervention. As may be seen, the biasing member 330 may be positioned above the shoulder 326 of the piston 325 and configured to exert an increasing axial (e.g., downward) force on the piston 325 as the piston 325 moves upward. After the slickline wellbore intervention, the pressurized fluid may flow back out of the port 335, and the biasing member 330 may push the piston 325 back downward, allowing the packer elements 345 to decompress.

The slickline stuffing box 900 may also include some elements that are not present in the slickline stuffing box 300. For example, the slickline stuffing box 900 may include a second port 337 that is configured to introduce a liquid into a second chamber 338. In the embodiment shown, the second port 337 is coupled to the lower body 355, and the second chamber 338 is below the piston 325 and/or the first chamber 336. In another embodiment, the second port 337 may instead be coupled to the upper body 320, and the second chamber 338 may be positioned above the piston 325 and/or the first chamber 336. In this embodiment, the liquid may be introduced to contact the packer elements 345. The liquid may include one or more chemicals (e.g., glycol, anti-freeze, lubricant). The second chamber 338 may also or instead receive an absorbent packer (e.g., a felt packer) that can soak in lubricant and continue to lubricate the slickline 305 or 306 as it passes therethrough.

The slickline stuffing box 900 may also include a packer bushing 905. The packer bushing 905 may be positioned at least partially above and/or within the upper body 320. For example, the packer bushing 905 may include outer threads that are configured to engage inner threads on the upper body 320. The packer bushing 905 may also be positioned above (e.g., in direct contact with) the packer elements 345. When torqued, the packer bushing 905 may exert a downward force onto the packer elements 345, which compresses the packer elements 345.

The slickline stuffing box 900 may also include a packer cap nut 910. The packer cap nut 910 may be positioned at least partially above and/or within the upper body 320. The packer cap nut 910 may also be positioned at least partially around the packer bushing 905. The packer cap nut 910 may include outer threads that are configured to engage inner threads on the upper body 320. The packer cap nut 910 may secure the packer bushing 905 (e.g., axially) between the packer cap nut 910 and the upper body 320. For example, the packer cap nut 910 may be torqued to compress the packer elements 345 without using hydraulic pressure.

The slickline stuffing box 900 may also include a sheave bracket nut 915. The sheave bracket nut 915 may be positioned at least partially around the packer bushing 905, the packer cap nut 910, the upper body 320, or a combination thereof. For example, the sheave bracket nut 915 may include inner threads that are configured to engage outer threads on the upper body 320. The sheave bracket nut 915 may secure the sheave bracket 312 on/around the upper body 320.

Figure 10A:
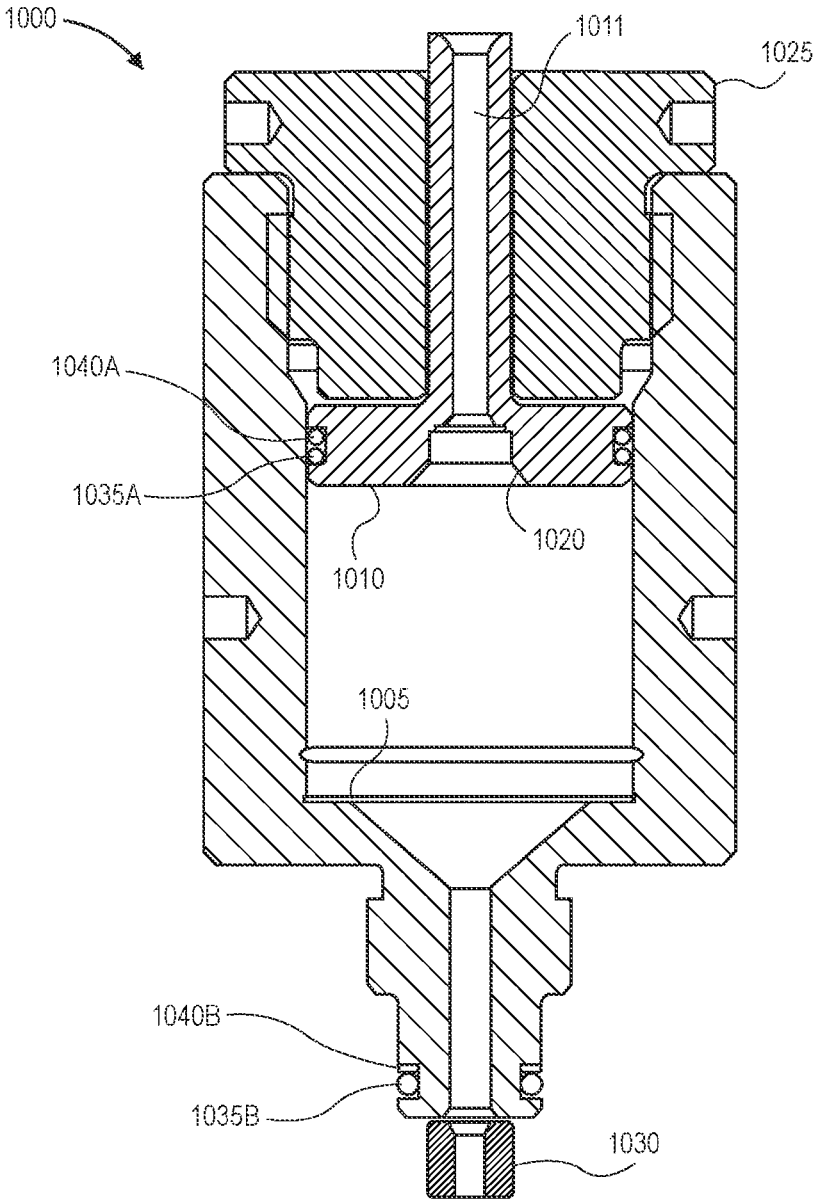
FIG. 10A illustrates a cross-sectional side view of a conversion housing that is configured to be positioned at least partially in and/or coupled to the slickline stuffing box (in FIGS. 9A and 9B), according to an embodiment.
Figure 10B:
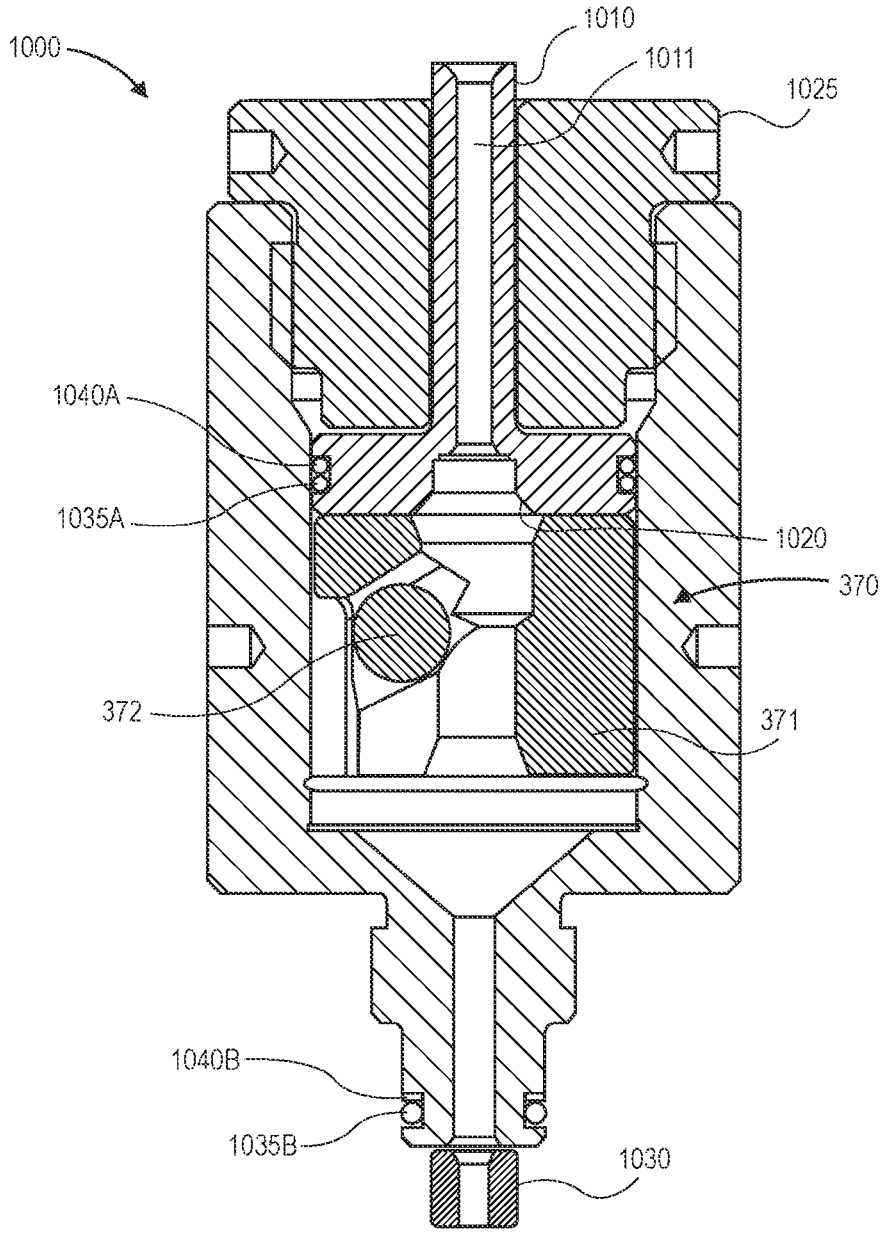
FIG. 10B illustrates a cross-sectional side view of the conversion housing with a valve positioned therein, according to an embodiment.

FIG. 10A illustrates a cross-sectional side view of a conversion housing 1000 that is configured to be positioned at least partially in and/or coupled to the slickline stuffing box 900, according to an embodiment. FIG. 10B illustrates a cross-sectional side view of the conversion housing 1000 with the valve 370 positioned therein, according to an embodiment. As with the conversion housing 400, the conversion housing 1000 may be installed/used to move the valve 370 from the lower portion of the slickline stuffing box 900 to the upper portion of the slickline stuffing box 900 (e.g., to perform a slickline wellbore intervention using the digital slickline 306).

The conversion housing 1000 may include or define a lower shoulder 1005, and the valve 370 may be configured to sit on the shoulder 1005. The conversion housing 1000 may include a retainer bushing 1010. The retainer bushing 1010 is configured to be positioned at least partially within the conversion housing 1000. The valve 370 may be secured (e.g., axially) between the lower shoulder 1005 and the retainer bushing 1010. An axial bore 1011 may extend (e.g., vertically) through the retainer bushing 1010. The (e.g., digital) slickline 306 may extend through the bore 1011. The retainer bushing 1010 may also include or define a downward-facing seat 1020 that is configured to receive the ball 372 when the wellbore pressure pushes the ball 372 upward. The ball 372 may form a seal against the seat 1020 to control/contain the wellbore pressure therebelow.

The conversion housing 1000 may also include a cap 1025. The cap 1025 may be positioned at least partially within and/or above the conversion housing 1000. The cap 1025 may also be positioned at least partially around and/or above the retainer bushing 1010. The cap 1025 may include outer threads that are configured to engage with inner threads on the conversion housing 1000.

The conversion housing 1000 may also include a packer bushing 1030. The packer bushing 1030 may be the same as, or different from the packer bushing 905 in FIG. 9B. The packer bushing 1030 may be positioned below the conversion housing 1000. The packer bushing 1030 may also be positioned above (e.g., in direct contact with) the packer elements 345. When torqued, the packer bushing 1030 may exert a downward force onto the packer elements 345, which compresses the packer elements 345.

The conversion housing 1000 may also include one or more seals (two are shown: 1035A, 1035B) and one or more backup rings (two are shown 1040A, 1040B). The seals 1035A, 1035B may be or include elastomeric O-rings. The first seal 1035A and/or the first backup ring 1040A may be positioned at least partially around (e.g., in a recess in) the retainer bushing 1010. The second seal 1035B and/or the second backup ring 1040B may be positioned at least partially around (e.g., in a recess in) the conversion housing 1000. For example, the second seal 1035B and/or the second backup ring 1040B may be positioned vertically between the lower shoulder 1005 and the packer bushing 1030.

Figure 11A:
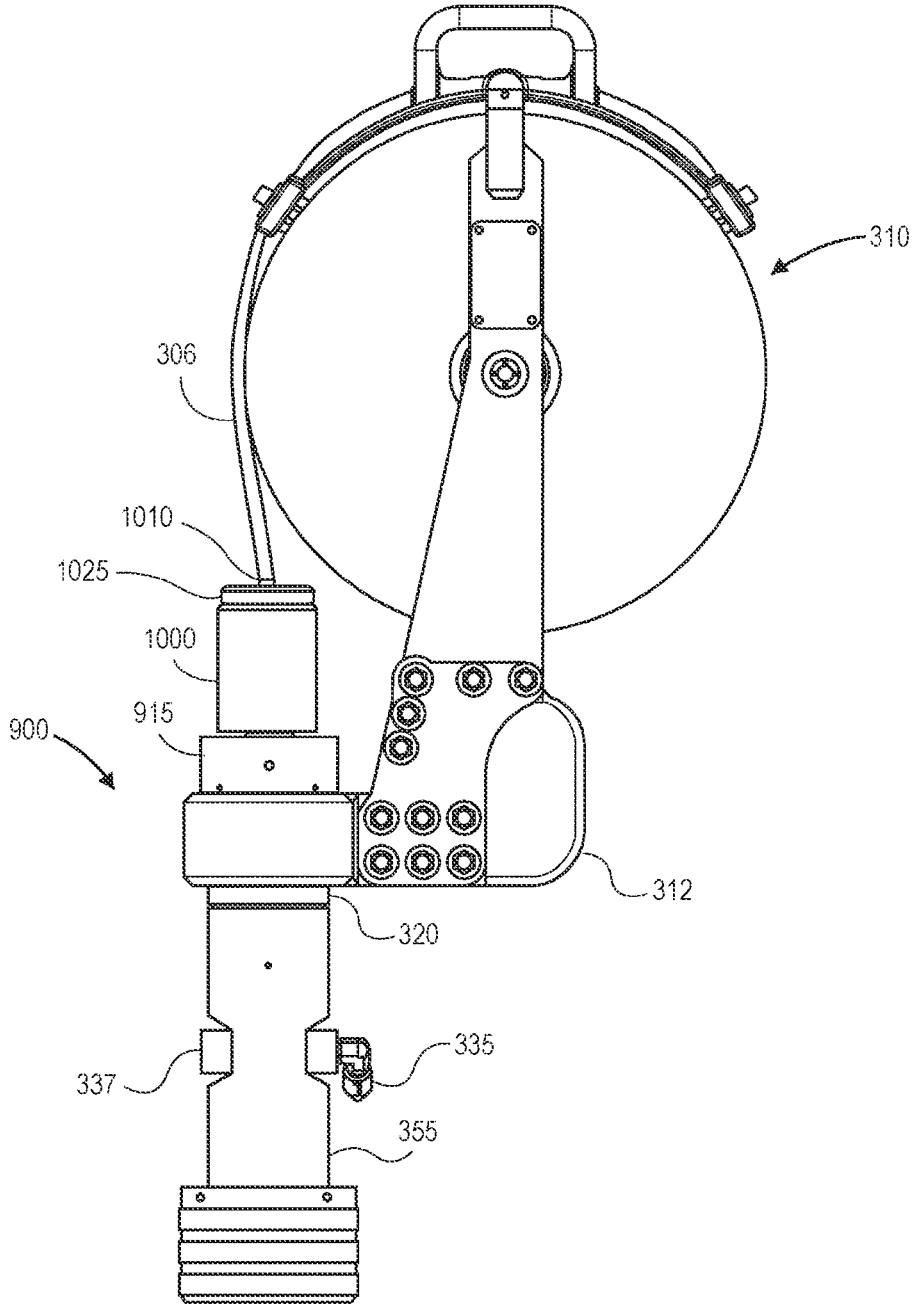
FIG. 11A illustrates a side view of the slickline stuffing box (from FIGS. 9A and 9B) in a second configuration, according to an embodiment.
Figure 11B:
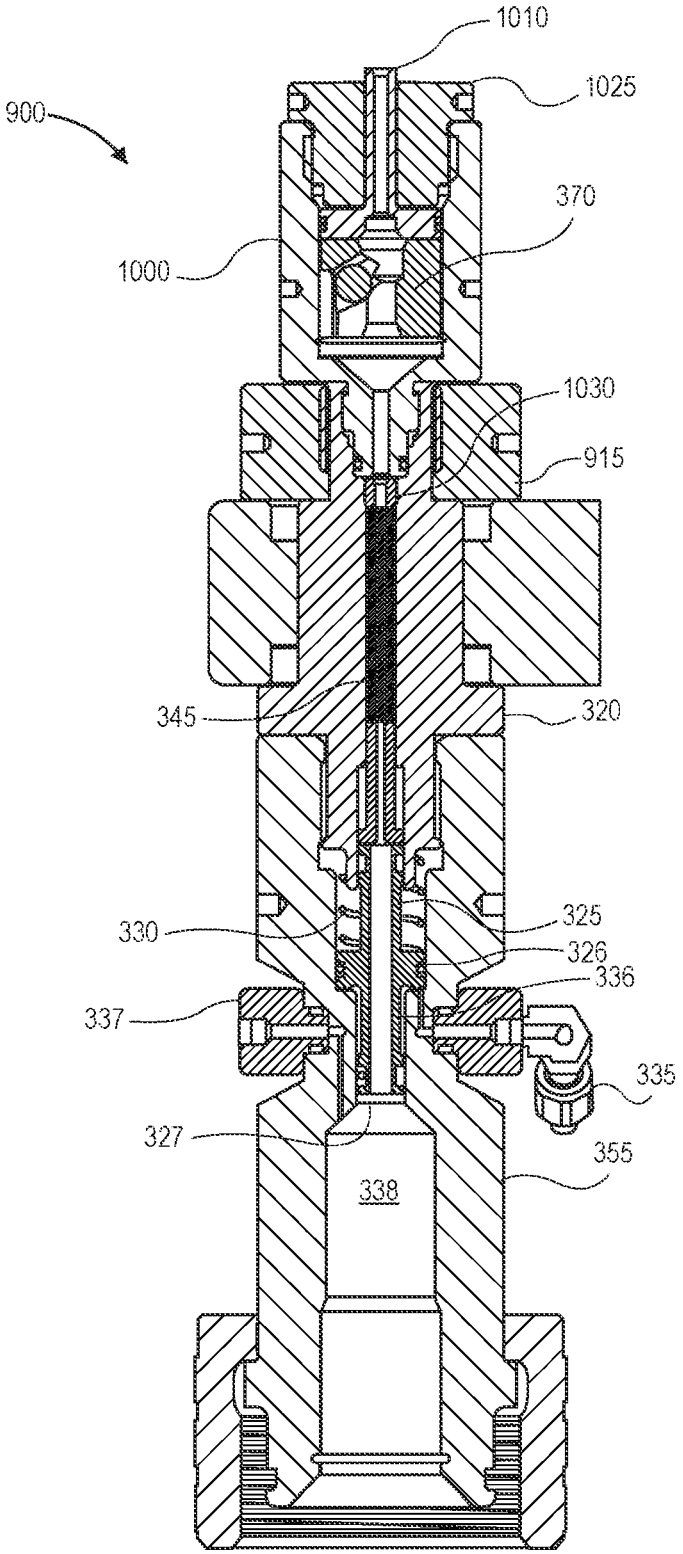
FIG. 11B illustrates a cross-sectional side view of the slickline stuffing box in the second configuration, according to an embodiment.

FIGS. 11A and 11B illustrate a side view and a cross-sectional side view of the slickline stuffing box 900 in a second configuration, according to an embodiment. In the second configuration, the valve 370 may be removed from the lower portion of the slickline stuffing box 900 and relocated to an upper portion of the slickline stuffing box 900. To accomplish this, the packer bushing 905 and/or the packer cap nut 910 may be removed. As described in greater detail below, in one embodiment, once the packer bushing 905 and/or the packer cap nut 910 are removed, the packer elements 345 may be removed and/or replaced.

In addition, once the packer bushing 905 and/or the packer cap nut 910 are removed, the conversion housing 1000 may be positioned above and/or at least partially within the upper body 320. For example, the conversion housing 1000 may include outer threads that are configured to engage inner threads of the upper body 320.

The valve 370 may be positioned at least partially within the conversion housing 1000. The retainer bushing 1010 and/or cap 1025 may be positioned above and/or at least partially within the conversion housing 1000. As mentioned above, the valve 370 may be secured (e.g., vertically) between the shoulder 1005 of the conversion housing 1000 and the retainer bushing 1010. Thus, the conversion housing 1000 may allow the valve 370 to be moved/relocated to be above the packer elements 345. The valve 370 may be in this position when the second slickline wellbore intervention is performed (e.g., using the digital slickline 306).

Figure 12:
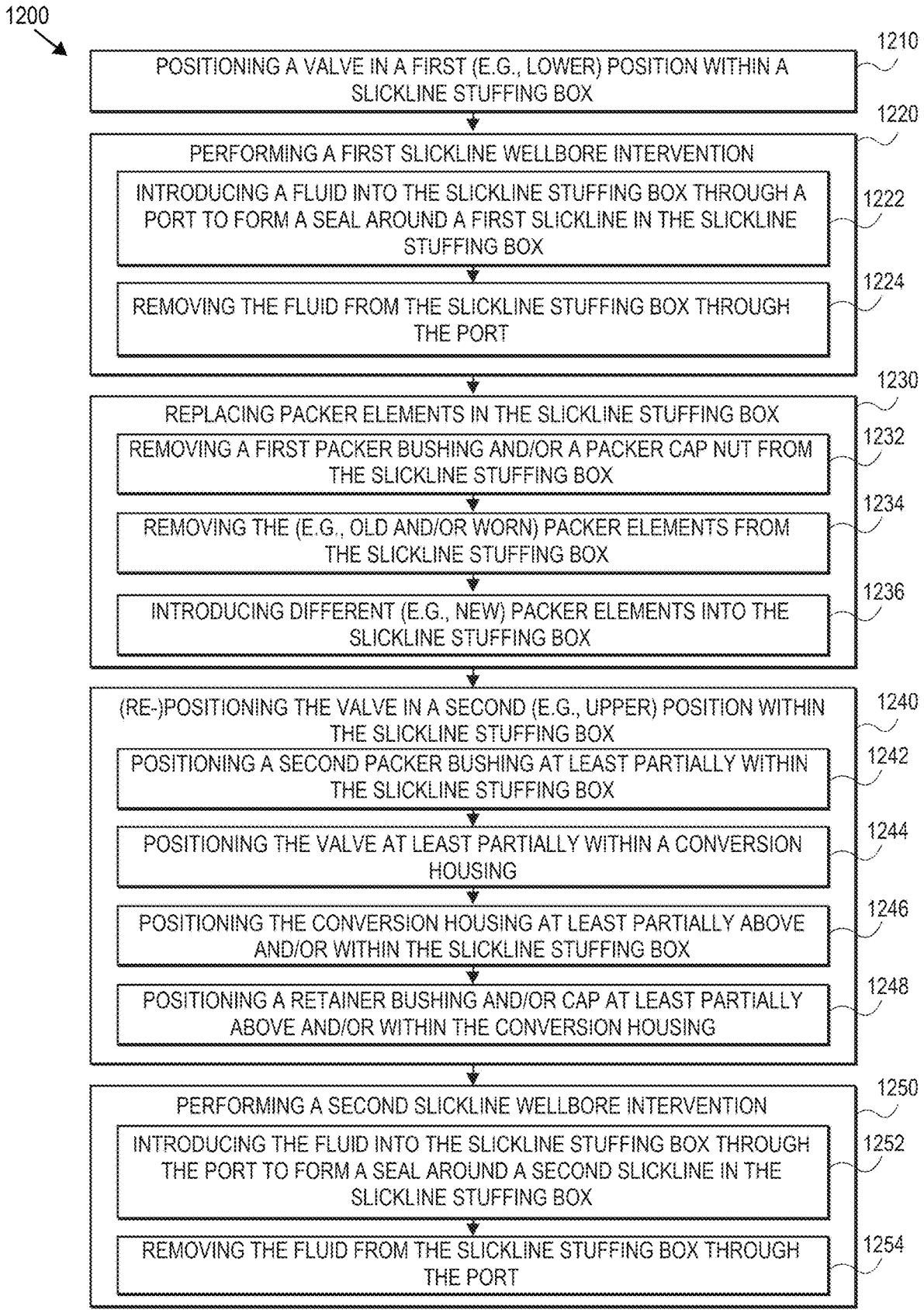
FIG. 12 illustrates a flowchart of a method for converting the slickline stuffing box to move the valve from a first (e.g., lower) position to a second (e.g., upper) position, according to an embodiment.

FIG. 12 illustrates a flowchart of a method 1200 for converting the slickline stuffing box 300 and/or performing a slickline wellbore intervention, according to an embodiment. An illustrative order of the method 1200 is provided below; however, one or more portions of the method 1200 may be performed in a different order, combined, repeated, or omitted.

The method 1200 may include positioning the valve 370 in a first (e.g., lower) position within the slickline stuffing box 900, as at 1210. This is shown in FIGS. 9A and 9B. The first position may be below the packer elements 345. The first position may also or instead be at least partially within the lower body 355.

The method 1200 may also include performing a first slickline wellbore intervention, as at 1220. The first slickline wellbore intervention may be performed using a first (e.g., non-digital) slickline 305 while the valve 370 is in the first position.

Performing the first slickline wellbore intervention may include introducing a fluid into the slickline stuffing box 900 through the port 335, as at 1222. The fluid may be introduced into the chamber 336. The fluid may have a pressure such that when the fluid is introduced into the chamber(s) 336, the fluid exerts an upward force on the piston 325 that exceeds a downward force exerted on the piston 325 by the biasing member 330. As a result, the piston 325 moves upward, which compresses the biasing member 330 and the packer elements 345. As mentioned above, compressing the packer elements 345 may create a static and/or dynamic seal with the outer surface of the slickline 305 and/or the inner surface of the upper body 320. This seal may allow the first slickline wellbore intervention to take place in the wellbore.

Performing the first slickline wellbore intervention may also include removing the fluid from the slickline stuffing box 300 through the port 335, as at 1224. For example, after the first slickline wellbore intervention has occurred, the fluid may flow out of the chamber 336 through the port 335. This may allow the biasing member 330 to push the piston 325 back downward, which decompresses the biasing member 330 and the packer elements 345.

The method 1200 may also include replacing the packer elements 345, as at 1230. Replacing the packer elements 345 may include removing the packer bushing 905 and/or packer cap nut 910, as at 1232. Replacing the packer elements 345 may also include removing the (e.g., old and/or worn) packer elements 345 from the slickline stuffing box 900, as at 1234. Replacing the packer elements 345 may also include introducing different (e.g., new) packer elements 345 into the slickline stuffing box 900, as at 1236. For example, the different (e.g., new) packer elements 345 may be positioned in the upper body 320 in the same location that the old packer elements 345 were positioned prior to being removed.

The packer elements 345 may be replaced without decoupling and/or removing the sheave wheel assembly 310 and/or the sheave wheel bracket 312. In addition, the chamber(s) 336, 338 may not be exposed to atmosphere when the packer elements 345 are removed and/or replaced. As a result, pressure testing the chamber(s) 336, 338 after the packer elements 345 are removed and/or replaced may be omitted.

The method 1200 may also include (re-)positioning the valve 370 in a second (e.g., upper) position within the slickline stuffing box 900, as at 1240. This is shown in FIGS. 11A and 11B. The second position may be above the (e.g., new/different) packer elements 345. The second position may also or instead be above the upper body 320. In one embodiment, the valve 370 may be (re-)positioned at the same wellbore and/or the same wellsite where the first slickline wellbore intervention occurred. In another embodiment, the valve 370 may be (re-)positioned at a different wellbore and/or a different wellsite than where the first slickline wellbore intervention occurred.

Positioning (or re-positioning) the valve 370 may also include positioning the packer bushing 1030 at least partially within the slickline stuffing box 900, as at 1242. More particularly, the packer bushing 1030 may be positioned at least partially within the upper body 320. This may occur while the packer bushing 905 and/or packer cap nut 910 are removed.

Positioning (or re-positioning) the valve 370 may include positioning the valve 370 at least partially within the conversion housing 1000, as at 1244. More particularly, the valve 370 may be removed from the lower body 355 and positioned on and/or above (or otherwise in contact with) the shoulder 1005 in the conversion housing 1000.

Positioning (or re-positioning) the valve 370 may also include positioning the conversion housing 1000 at least partially above and/or within the slickline stuffing box 900, as at 1246. More particularly, the conversion housing 1000 may be positioned at least partially above and/or within the upper body 320. For example, the conversion housing 1000 may have outer threads that are configured to engage with inner threads of the upper housing 320. The packer bushing 1030 may be positioned (e.g., vertically) between the conversion housing 1000 and the (e.g., new/different) packer elements 345.

Positioning (or re-positioning) the valve 370 may also include positioning the retainer bushing 1010 and/or cap 1025 at least partially above and/or within the conversion housing 1000, as at 1248. The valve 370 may be secured (e.g., vertically) between the shoulder 1005 in the conversion housing 1000 and the retainer bushing 1010 and/or cap 1025.

The method 1200 may also include performing a second slickline wellbore intervention, as at 1250. The second intervention may be performed using the second (e.g., digital) slickline 306 while the valve 370 is in the second position.

Performing the second slickline wellbore intervention may include introducing the fluid into the slickline stuffing box 900 through the port 335, as at 1252. The fluid may be introduced into the chamber 336. The fluid may have a pressure such that when the fluid is introduced into the chamber 336, the fluid exerts an upward force on the piston 325 that exceeds a downward force exerted on the piston 325 by the biasing member 330. As a result, the piston 325 moves upward, which compresses the biasing member 330 and the packer elements 345. As mentioned above, compressing the packer elements 345 may create a static and/or dynamic seal with the outer surface of the slickline 305 and/or the inner surface of the upper body 320. This seal may allow the second slickline wellbore intervention to take place.

Performing the second slickline wellbore intervention may also include removing the fluid from the slickline stuffing box 900 through the port 335, as at 1254. For example, after the second slickline wellbore intervention has occurred, the fluid may flow out of the chamber(s) 336, 338 through the ports 335, 337. This may allow the biasing member 330 to push the piston 325 back downward, which decompresses the biasing member 330 and the packer elements 345.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A slickline stuffing box, comprising:

a piston configured to move in response to a force exerted thereon by a pressurized fluid;

a packer element positioned above the piston, wherein the packer element is configured to compress axially and expand radially, in response to movement of the piston, to seal around a slickline to contain a pressure within a wellbore during a slickline wellbore intervention;

a valve configured to be positioned below the packer element in a first configuration of the slickline stuffing box and above the packer element in a second configuration of the slickline stuffing box, wherein the valve is configured to contain the pressure within the wellbore in response to the slickline breaking and falling down and out of the slickline stuffing box;

a housing that is configured to be positioned above the packer element when the slickline stuffing box is in the second configuration, wherein the valve is configured to be positioned within the housing when the slickline stuffing box is in the second configuration; and a retainer bushing that is configured to be positioned at least partially within the housing when the slickline stuffing box is in the second configuration, wherein the valve is positioned vertically between the retainer bushing and an inner shoulder of the housing.

2. The slickline stuffing box of claim 1, wherein the valve is not positioned within the housing when the slickline stuffing box is in the first configuration.

3. The slickline stuffing box of claim 1, wherein the retainer bushing defines a downward-facing seat, and wherein the valve comprises a ball that is configured to seal with the seat to contain the pressure within the wellbore in response to the slickline breaking and falling down and out of the slickline stuffing box.

4. The slickline stuffing box of claim 1, further comprising a cap that is configured to be positioned at least partially within the housing and around at least a portion of the retainer bushing, wherein the cap comprises outer threads that are configured to engage with inner threads of the housing.

5. The slickline stuffing box of claim 1, further comprising a packer bushing that is configured to be positioned at least partially between the housing and the packer element.

6. The slickline stuffing box of claim 1, wherein the slickline stuffing box in the first configuration is configured to have a first slickline extend therethrough and to seal around the first slickline to contain the pressure within the wellbore therebelow during a first slickline wellbore intervention, and wherein the slickline stuffing box in the second configuration is configured to have a second slickline extend therethrough and to seal around the second slickline to contain the pressure within the wellbore therebelow during a second slickline wellbore intervention.

7. The slickline stuffing box of claim 6, wherein the first slickline comprises a non-digital slickline, and wherein the second slickline comprises a digital slickline.

8. The slickline stuffing box of claim 6, wherein the first slickline wellbore intervention differs from the second slickline wellbore intervention.

9. A slickline stuffing box, comprising:

a housing defining an inner shoulder;

a ball check valve (BCV) configured to be positioned at least partially within the housing, wherein the BCV comprises a ball;

a retainer bushing configured to be positioned at least partially within the housing, wherein the BCV is configured to be positioned vertically between the retainer bushing and the inner shoulder of the housing, wherein a lower surface of the retainer bushing defines a downward-facing seat, and wherein the ball is configured to seal with the seat to contain a pressure within a wellbore in response to a slickline breaking and falling down and out of the slickline stuffing box;

a cap configured to be positioned at least partially within the housing and at least partially around the retainer bushing;

an upper body coupled to and positioned at least partially below the housing, wherein the housing is positioned at least partially within the upper body;

one or more packer elements positioned at least partially within the upper body;

a lower body coupled to and positioned at least partially below the upper body;

a piston positioned at least partially within the lower body;

a biasing member positioned at least partially within the lower body; and a port coupled to the lower body, wherein the port provides a path of fluid communication between an exterior of the lower body and a chamber within the lower body, wherein the piston moves and compresses the biasing member and the one or more packer elements in response to a fluid flowing into the chamber, and wherein the one or more packer elements expand radially in response to being compressed, which causes the one or more packer elements to seal around the slickline to contain the pressure within the wellbore during a slickline wellbore intervention.

10. The slickline stuffing box of claim 9, wherein the BCV is configured to be positioned at least partially within the lower body in a first configuration of the slickline stuffing box, and wherein the BCV is configured to be positioned at least partially within the housing in a second configuration of the slickline stuffing box.

11. The slickline stuffing box of claim 9, further comprising a second port coupled to the lower body, wherein the second port provides a path of fluid communication between the exterior of the lower body and a second chamber within the lower body, wherein the second chamber is below the piston, and wherein a chemical or lubricant is positioned in the second chamber.

12. The slickline stuffing box of claim 9, further comprising a second port coupled to the upper body, wherein the second port provides a path of fluid communication between the exterior of the lower body and a second chamber within the upper body, wherein the second chamber is above the piston, and wherein a chemical or lubricant is positioned in the second chamber.

13. The slickline stuffing box of claim 9, wherein the cap comprises a packer cap nut that is configured to be torqued to compress the packer elements.

14. A method, comprising:

removing a first packer bushing from a slickline stuffing box;

removing a first packer element from the slickline stuffing box while the first packer bushing is removed without decoupling a sheave wheel assembly from the slickline stuffing box;

introducing a second packer element into the slickline stuffing box while the first packer bushing is removed and after the first packer element is removed; and repositioning a valve from a first position within the slickline stuffing box to a second position within the slickline stuffing box, wherein the valve in the first position is below the second packer element in the slickline stuffing box, wherein the valve in the second position is above the second packer element in the slickline stuffing box, and wherein the repositioning comprises:

positioning a second packer bushing in the slickline stuffing box;

positioning the valve within a housing;

positioning a retainer bushing at least partially within the housing, wherein the valve is positioned between the retainer bushing and an inner shoulder of the housing; and positioning the housing at least partially within the slickline stuffing box, wherein the second packer bushing is positioned within the housing and the second packer element.

15. The method of claim 14, wherein the first packer element is removed and the second packer element is introduced without exposing a chamber in the slickline stuffing box to atmosphere such that pressure testing of the chamber is omitted in response to introducing the second packer element, and wherein the chamber is positioned below the first packer element, the second packer element, or both.

16. The method of claim 14, further comprising:

performing a first slickline wellbore intervention using a non-digital slickline that extends through the slickline stuffing box while the valve is in the first position; and performing a second slickline wellbore intervention using a digital slickline that extends through the slickline stuffing box while the valve is in the second position.

* * * * *